US010844764B2

(12) United States Patent
Brandl et al.

(10) Patent No.: US 10,844,764 B2
(45) Date of Patent: Nov. 24, 2020

(54) DOSING AND MIXING ARRANGEMENT FOR USE IN EXHAUST AFTERTREATMENT

(71) Applicant: DONALDSON COMPANY, INC., Minneapolis, MN (US)

(72) Inventors: Mark Thomas Brandl, Ham Lake, MN (US); Bruce Hoppenstedt, Lakeville, MN (US); Stephen Ronald Schiller, Minneapolis, MN (US); Matthew S. Whitten, St. Paul, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 9 days.

(21) Appl. No.: 16/042,060

(22) Filed: Jul. 23, 2018

(65) Prior Publication Data

US 2018/0328248 A1 Nov. 15, 2018

Related U.S. Application Data

(63) Continuation of application No. 15/369,238, filed on Dec. 5, 2016, now Pat. No. 10,030,562, which is a (Continued)

(51) Int. Cl.
*F01N 3/20* (2006.01)
*F01N 3/28* (2006.01)
(Continued)

(52) U.S. Cl.
CPC ..... *F01N 3/208* (2013.01); *B01F 3/04049* (2013.01); *B01F 5/0057* (2013.01); (Continued)

(58) Field of Classification Search
CPC ..... F01N 3/206; F01N 3/2066; F01N 3/208; F01N 3/2892; F01N 2240/20; (Continued)

(56) References Cited

U.S. PATENT DOCUMENTS 7,448,206 B2 11/2008 Meingast et al.
7,877,983 B2 2/2011 Kunkel et al.
(Continued)

FOREIGN PATENT DOCUMENTS

DE 10 2010 025 611 1/2011
DE 10 2009 036 511 2/2011
(Continued)

OTHER PUBLICATIONS

International Search Report and Written Opinion for Application No. PCT/US2015/013860 dated Aug. 25, 2015.
(Continued)

*Primary Examiner* — Audrey K Bradley
(74) *Attorney, Agent, or Firm* — Merchant & Gould P.C.

(57) ABSTRACT

A dosing and mixing arrangement including an exhaust conduit defining a central axis; a mixing conduit positioned within the exhaust conduit; a dispersing arrangement (e.g., a mesh) disposed at the upstream end of the mixing conduit; an injector coupled to the exhaust conduit and configured to direct reactants into the exhaust conduit towards the mesh; and an annular bypass defined between the mixing conduit and the exhaust conduit for allowing exhaust to bypass the upstream end of the mixing conduit and to enter the mixing conduit downstream of the mesh.

22 Claims, 20 Drawing Sheets

Related U.S. Application Data continuation of application No. 14/610,255, filed on Jan. 30, 2015, now Pat. No. 9,528,415.

(60) Provisional application No. 61/934,489, filed on Jan. 31, 2014, provisional application No. 61/980,441, filed on Apr. 16, 2014, provisional application No. 62/069,579, filed on Oct. 28, 2014.

(51) Int. Cl.

| | |
|---|---|
| ***B01F 3/04*** | (2006.01) |
| ***B01F 5/00*** | (2006.01) |
| ***B01F 5/02*** | (2006.01) |
| ***B01F 5/04*** | (2006.01) |
| ***B01F 5/06*** | (2006.01) |

(52) U.S. Cl.

CPC ..... *B01F 5/0268* (2013.01); *B01F 5/0473* (2013.01); *B01F 5/0642* (2013.01); *F01N 3/206* (2013.01); *F01N 3/2066* (2013.01); *F01N 3/2892* (2013.01); *B01F 2005/0091* (2013.01); *F01N 2240/20* (2013.01); *F01N 2410/00* (2013.01); *F01N 2470/24* (2013.01); *F01N 2610/01* (2013.01); *F01N 2610/02* (2013.01); *F01N 2610/1453* (2013.01)

(58) Field of Classification Search

CPC ..... F01N 2410/00; F01N 2470/24; F01N 2610/01; F01N 2610/02; F01N 2610/1453; B01F 3/04049; B01F 5/0473; B01F 5/0057; B01F 5/0268; B01F 5/0642; B01F 2005/0091

USPC ..... 60/324

See application file for complete search history.

(56) References Cited

U.S. PATENT DOCUMENTS

| | | | | |
|---|---|---|---|---|
| 8,499,548 | B2 | 8/2013 | De Rudder et al. | |
| 8,915,064 | B2 | 12/2014 | Blaisdell et al. | |
| 8,938,954 | B2 | 1/2015 | De Rudder et al. | |
| 9,528,415 | B2 | 12/2016 | Brandl et al. | |
| 2006/0283181 | A1* | 12/2006 | Crawley | F01N 3/0231 60/303 |
| 2009/0266064 | A1 | 10/2009 | Zheng et al. | |
| 2010/0170234 | A1 | 7/2010 | Way | |
| 2010/0263359 | A1 | 10/2010 | Haverkamp | |
| 2011/0023461 | A1 | 2/2011 | Strots | |
| 2011/0146254 | A1 | 6/2011 | Yi et al. | |
| 2011/0239631 | A1 | 10/2011 | Bui | |
| 2011/0308234 | A1 | 12/2011 | De Rudder et al. | |
| 2012/0151902 | A1 | 6/2012 | Yi | |
| 2013/0239546 | A1 | 9/2013 | Levin | |
| 2014/0033686 | A1* | 2/2014 | Fischer | B01F 5/0473 60/286 |
| 2014/0093439 | A1 | 4/2014 | De Rudder et al. | |
| 2015/0016214 | A1* | 1/2015 | Mueller | B01F 5/0616 366/337 |
| 2015/0040537 | A1 | 2/2015 | Hicks | |
| 2015/0132192 | A1 | 5/2015 | De Rudder et al. | |
| 2015/0211404 | A1 | 7/2015 | Blaisdell et al. | |
| 2015/0260072 | A1 | 9/2015 | De Rudder et al. | |

FOREIGN PATENT DOCUMENTS

| | | |
|---|---|---|
| EP | 0 487 886 | 4/1994 |
| EP | 0 555 746 | 9/1997 |
| EP | 0 939 207 | 9/1999 |
| EP | 1 712 756 | 3/2009 |
| EP | 1 781 908 | 3/2010 |
| EP | 1 714 011 | 8/2010 |
| EP | 2 465 602 | 5/2013 |
| EP | 2 732 869 | 5/2014 |
| JP | 2013-245677 A | 12/2013 |
| WO | 2009/037924 A1 | 3/2009 |
| WO | WO 2012/089290 | 7/2012 |
| WO | WO 2013/136614 | 9/2013 |

OTHER PUBLICATIONS

Partial International Search Report for Application No. PCT/US2015/013860 dated Apr. 13, 2015.

* cited by examiner

DOSING AND MIXING ARRANGEMENT FOR USE IN EXHAUST AFTERTREATMENT

CROSS-REFERENCE TO RELATED APPLICATIONS

This application is a continuation of application Ser. No. 15/369,238, filed Dec. 5, 2016, now U.S. Pat. No. 10,030,562, which is a continuation of application Ser. No. 14/610,255, filed Jan. 30, 2015, now U.S. Pat. No. 9,528,415, which application claims the benefit of: U.S. Provisional Application No. 61/934,489, filed Jan. 31, 2014; U.S. Provisional Application No. 61/980,441, filed Apr. 16, 2014; and U.S. Provisional Application No. 62/069,579, filed Oct. 28, 2014, which applications are incorporated herein by reference in their entirety.

BACKGROUND

Vehicles equipped with internal combustion engines (e.g., diesel engines) typically include exhaust systems that have aftertreatment components, such as selective catalytic reduction (SCR) catalyst devices, lean NOx catalyst devices, or lean NOx trap devices, to reduce the amount of undesirable gases, such as nitrogen oxides (NOx), in the exhaust. In order for these types of aftertreatment devices to work properly, an injector injects reactants (e.g., a reductant such as urea, ammonia, or hydrocarbons), into the exhaust gas. As the exhaust gas and reactants flow through the aftertreatment device, the exhaust gas and reactants convert the undesirable gases, such as NOx, into more acceptable gases, such as nitrogen and oxygen. However, the efficiency of the aftertreatment system depends upon how well the reactants are evaporated and how evenly the reactants are mixed with the exhaust gases. Therefore, a flow device that provides evaporation and mixing of exhaust gases and reactants is desirable.

SCR exhaust treatment devices focus on the reduction of nitrogen oxides. In SCR systems, a reductant (e.g., aqueous urea solution) is dosed into the exhaust stream. The reductant reacts with nitrogen oxides while passing through an SCR catalyst to reduce the nitrogen oxides to nitrogen and water. When aqueous urea is used as a reductant, the aqueous urea is converted to ammonia which in turn reacts with the nitrogen oxides to covert the nitrogen oxides to nitrogen and water. Dosing, mixing and evaporation of aqueous urea solution can be challenging because the urea and by-products from the reaction of urea to ammonia can form deposits on the surfaces of the aftertreatment devices. Such deposits can accumulate over time and partially block or otherwise disturb effective exhaust flow through the aftertreatment device.

SUMMARY

Aspects of the disclosure related to a dosing and mixing arrangement including an exhaust conduit defining a central axis; a mixing conduit positioned within the exhaust conduit; a dispersing arrangement disposed at an upstream end of the mixing conduit; an injector coupled to the exhaust conduit and configured to direct reactants into the exhaust conduit towards the dispersing arrangement; and a bypass for allowing exhaust to bypass the upstream end of the mixing conduit and to enter the mixing conduit downstream of the dispersing arrangement. An interior of the mixing conduit is devoid of structure in longitudinal alignment with an upstream face of the mixing conduit.

In some implementations, the dispersing arrangement includes a mesh of one or more wires. It is noted that the use of the term "wire" is not intended to connote a particular minimum transverse cross-dimension (e.g., thickness or diameter) of the metal wire. In certain examples, the mesh includes one or more wires having diameters of no more than 0.01 inches. In certain examples, the mesh includes one or more wires having diameters of no more than 0.008 inches. In certain examples, the mesh includes one or more wires having diameters of no more than 0.006 inches. In various implementations, the wires of the mesh having diameters that no more than 100 times, 1000 times, 10,000 times, or 100,000 times smaller than a diameter of the upstream end of the mixing conduit.

In some implementations, the bypass is defined between the mixing conduit and the exhaust conduit. In an example, the bypass includes an annular passage.

In some implementations, the mixing conduit includes a structure to impart rotation to exhaust flowing into the mixing conduit from the annular bypass. In certain examples, the structure includes louvers that extend from the mixing conduit.

In some implementations, the mixing conduit defines a plurality of apertures therethrough at a location downstream of the dispersing arrangement. The apertures are configured to allow exhaust bypassing the upstream end of the mixing conduit. In certain examples, the apertures include a first set of apertures at a first axial location along the mixing conduit. In an example, the first set of apertures direct at least some exhaust from the bypass into the mixing conduit to carry droplets of the reactants away from an inner surface of the mixing conduit at a bottom of the mixing conduit. In certain examples, the apertures also include a second set of apertures at a second axial location downstream of the first axial location. In an example, the first set of apertures extends around less than a circumference of the mixing conduit, and the second set of apertures extends around the circumference of the mixing conduit second set of apertures.

In some implementations, the dispersing arrangement includes a first region and a second region that is thinner than the first region. The first region extends across the upstream end of the mixing conduit and the second region restricts access to the bypass.

In certain examples, the second region extends at least partially across an opening that extends between a circumference of the first region and an inner surface of the exhaust conduit. In an example, the second region fully restricts access to the bypass. In an example, the second region extends over only a portion of the opening to provide unrestricted access to the bypass through the opening. In an example, at least one opening is defined between a circumference of the first region, at least one edge of the second region, and an inner surface of the exhaust conduit. In certain examples, the dispersing arrangement defines a plurality of opening to provide unrestricted access to the bypass. In certain examples, the second region includes a second mesh that extends at least partially across the first region and extends at least partially across an opening that extends between a circumference of the first region and an inner surface of the exhaust conduit. In an example, the second mesh material extends fully across the first region and fully across the opening. In certain examples, the second region includes a perforated plate.

In certain examples, a plane defined by the upstream end of the mixing conduit is not perpendicular to a longitudinal axis of the exhaust conduit. In certain examples, a plane defined by an upstream face of the dispersing arrangement is not perpendicular to a longitudinal axis of the exhaust conduit.

Other aspects of the disclosure are directed to a dosing and mixing arrangement including an exhaust conduit defining a central axis; a mixing conduit positioned within the exhaust conduit to be coaxial with or parallel to the central axis; an injector coupled to the exhaust conduit and configured to direct reactants into the exhaust conduit towards the dispersing arrangement; and a dispersing arrangement disposed at the upstream end of the mixing conduit. No portion of the mixing conduit extends inwardly beyond a circumference defined by an upstream face of the mixing conduit. The mixing conduit includes a reduced diameter section towards an upstream end and an expanding diameter section towards a downstream end. The reduced diameter section has a sidewall spaced radially inwardly from the exhaust conduit. The expanding diameter section defines apertures forming an exhaust entry region for allowing exhaust to enter the mixing conduit. A portion of the expanding diameter section contacts the exhaust conduit.

In certain implementations, louvers are provided at the apertures.

In certain implementations, the reduced diameter section defines a plurality of apertures forming another exhaust entry region. The exhaust entry regions are axially spaced from one another.

In certain implementations, the apertures at the expanding diameter section extend around a greater circumferential portion of the mixing conduit than the apertures at the reduced diameter section.

Other aspects of the disclosure are directed to an exhaust treatment system including an exhaust conduit defining a central axis; an injector mounted to the exhaust conduit for injecting reductant; a mesh having an upstream face angled relative to the central axis and facing at least partially toward the injector; a mixing conduit positioned within the exhaust conduit; and an annular by-pass defined between the mixing conduit and the exhaust conduit for allowing exhaust to bypass the upstream end of the mixing conduit. An upstream end of the mixing conduit is angled relative to the central axis of the exhaust conduit. The mixing conduit includes a truncated conical portion that tapers outwardly from a minor diameter to a major diameter. The major diameter defines the downstream end of the mixing conduit and is positioned at an inner surface of the exhaust conduit. The mixing conduit also includes a reduced diameter portion that extends from the upstream end of the mixing conduit to the minor diameter of the truncated conical portion. The mesh is mounted within the mixing conduit at the upstream end of the mixing conduit. The reduced diameter portion of the mixing conduit defines a first set of louvers positioned beneath the downstream face of the mesh; and the truncated conical portion defining a second set of louvers. A portion of the exhaust bypassing the upstream end of the mixing conduit is swirled into the mixing conduit in an upward direction through the first set of louvers and a remainder of the exhaust bypassing the upstream end of the mixing conduit is swirled into the mixing conduit through the second set of louvers.

In some implementations, the mesh extends fully across the cross-sectional area of the exhaust conduit. In an example, the mesh defines at least one opening providing unrestricted access to the bypass. In an example, the mesh defines a plurality of openings providing unrestricted access to the bypass.

In some implementations, a second mesh material extends fully across the cross-sectional area of the exhaust conduit at a location upstream of the dispersing mesh.

Other aspects of the disclosure are directed to an a dosing and mixing arrangement including an exhaust conduit through which exhaust can flow; an injector coupled to the exhaust conduit and configured to direct reactants into the exhaust conduit to be carried by the exhaust; a dispersing arrangement disposed within the exhaust conduit downstream of the injector; and a bypass passage for allowing a second portion of the exhaust to bypass the first portion of the dispersing arrangement and to continue flowing through the exhaust conduit downstream of the first portion of the dispersing arrangement. The dispersing arrangement includes a first region that is configured to break up droplets of the reactants as a first portion of the exhaust flows through the first region. The dispersing arrangement also has a second region that extends outwardly from the first region and is thinner than the first region. The second region of the dispersing arrangement at least partially covers and restricts access to the bypass passage.

In some implementations, a mixing apparatus imparts a rotation to the first and second portions of the exhaust flowing downstream of the dispersing arrangement. In certain examples, the mixing apparatus includes a mixing conduit positioned within the exhaust conduit downstream of the dispersing arrangement. The mixing conduit defines an axial inlet at which the first portion of the exhaust is received and the mixing conduit defining at least one radial inlet at which the second portion of the exhaust is received.

In certain examples, an upstream face of the dispersing arrangement is oriented at a non-perpendicular angle relative to a central axis of the exhaust conduit. In certain examples, the dispersing arrangement extends fully across an interior cross-sectional area of the exhaust conduit. In certain examples, the dispersing arrangement includes a mesh. In certain examples, the dispersing arrangement also includes a second, less restrictive mesh material in place of or in addition to the mesh.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
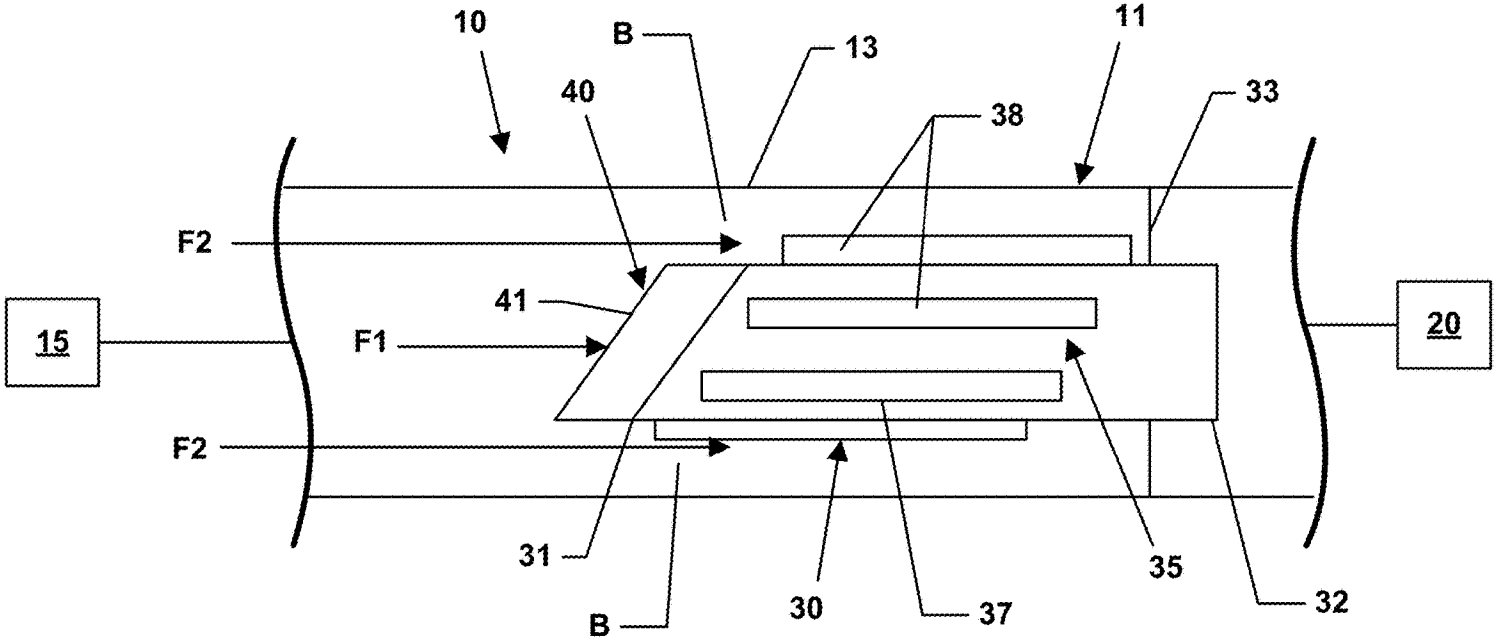
FIG. 1 is a schematic view of an aftertreatment system including an example dosing and mixing unit in accordance with the principles of the present disclosure.

FIG. 1 is a schematic diagram of an example dosing and mixing unit 11 of an example exhaust aftertreatment system 10 in accordance with the principles of the present disclosure. The exhaust aftertreatment system 10 includes an engine 15 from which exhaust is routed to the dosing and mixing unit 11. In an example, a flow straightener, focus nozzle, or swirl device is disposed between the engine 15 and the dosing and mixing unit 11. A dose of reactant is mixed into the exhaust at the dosing and mixing unit 11. The exhaust aftertreatment system 10 also can include a treatment substrate 20 to which the dosed and mixed exhaust is routed.

For example, the exhaust carrying the reactant can be routed to a selective catalytic reduction (SCR) catalyst device, a lean NOx catalyst, or a lean NOx trap. In some examples, the reactant can be a reductant such as urea or ammonia used in NOx reduction. In an example, the reactant can include aqueous urea. In an example, the reactant can include a diesel emission fluid (DEF). In other applications, the treatment substrate 20 can include a diesel oxidation catalyst (DOC) substrate, a diesel particulate filter (DPF) substrate, an SCR substrate and/or an SCR on Filter (SCRF). In such examples, the reactant can include a hydrocarbon that may be combusted to increase exhaust temperatures for regeneration purposes (e.g., soot combustion). Combinations of the above substrates also can be used.

The dosing and mixing unit 11 includes a mixing conduit 30 disposed within an exhaust conduit 13. The mixing conduit 30 has an upstream end 31 and a downstream end 32. In some implementations, the mixing conduit 30 includes a dispersing arrangement (e.g., a mesh, a sponge, and/or a tortuous path baffle arrangement) 40 at the upstream end 31. At least some exhaust flow F1 enters the mixing conduit 30 through the dispersing arrangement 40. In certain examples, the exhaust flow F1 axially enters the mixing conduit 30 through the upstream end 31. In an example, the exhaust flow F1 is swirling as the exhaust flow F1 enters the mixing conduit 30. The dispersing arrangement 40 breaks up droplets of reactant sprayed from an injector 50 (FIG. 2) to facilitate mixing of the reactant with the exhaust flowing through the mixing conduit 30.

In certain implementations, the upstream face 41 of the dispersing arrangement 40 is centered along the central axis of the exhaust conduit 13. In such implementations, the central axis need not be linear and can follow the contours of the exhaust conduit 13. In some implementations, the upstream face 41 of the dispersing arrangement 40 has a non-circular profile. In an example, the upstream face 41 of the dispersing arrangement 40 has an oblong profile. In certain implementations, a plane defined by an upstream face 41 of the dispersing arrangement 40 is oriented at a non-perpendicular angle relative to a central axis of the exhaust conduit 13.

The dispersing arrangement 40 is formed from a knit, a weave, or a jumbling of one or more metal wires. Each wire is sufficiently thin to facilitate heating of the wire. In an example, the dispersing arrangement 40 is formed from a continuous weave of a metal wire. In an example, the dispersing arrangement 40 is formed from stainless steel. In certain examples, the dispersing arrangement 40 is coated in $TiO_2$. The dispersing arrangement 40 reduces the flow rate of the exhaust entering the mixing conduit 30 through the upstream end 31 of the mixing conduit 30. In accordance with some aspects of the disclosure, the angled upstream face 41 of the dispersing arrangement 40 mitigates some of the backpressure. In accordance with some aspects of the disclosure, a bypass B mitigates some of the backpressure.

The bypass B enables other exhaust flow F2 to flow past the upstream end 31 of the mixing conduit 30 to mitigate backpressure. In certain examples, the bypass B enables the exhaust flow F2 to flow around the dispersing arrangement 40. The bypass B leads to one or more downstream entrances 35 into the mixing conduit 30. The other exhaust flow F2 flows along the bypass B and into the mixing conduit 30 through the downstream entrance(s) 35. In an example, an annular bypass B is provided at a circumferential gap between the mixing conduit 30 and the exhaust conduit 13. In another example, multiple bypasses flow along an exterior of the mixing conduit 30 to the downstream entrance(s) 35.

The exhaust passing through the mixing conduit 30 is heated at the engine 15. The heat facilitates vaporization of the reactant within the exhaust flow. The dispersing arrangement 40 may provide heat to some reactant to aid in the vaporization process when the exhaust flow F1 passes through the dispersing arrangement 40. In some implementations, exhaust flowing along the bypass B thermally insulates (at least partially) the mixing conduit 30 from the exhaust conduit 13. For example, the exhaust flowing along the bypass B may thermally insulate the upstream end 31 of the mixing conduit 30. In an example, the exhaust flowing along the bypass B thermally insulates the dispersing arrangement 40. Thermally insulating the upstream end 31 of the mixing conduit 30 and/or the dispersing arrangement 40 mitigates heat loss at these areas. Accordingly, the bypass B facilitates vaporization of the reactant by keeping the upstream end 31 of the mixing conduit 30 and/or the dispersing arrangement 40 at a higher temperature than if these areas contacted the exhaust conduit 13.

The mixing conduit 30 is configured to swirl exhaust passing through the mixing conduit 30. For example, the exhaust flow F2 entering the mixing conduit 30 at the downstream entrance(s) 35 may impart a swirl to the exhaust flow F1 axially entering the mixing conduit 30 through the dispersing arrangement 40. In certain examples, the exhaust swirls about a longitudinal axis extending between the first and second ends 31, 32. In other implementations, the exhaust can swirl about other orientations. In an example, the exhaust swirls as the exhaust flows within of the mixing conduit 30 and continues to swirl as the exhaust flows downstream of the mixing conduit 30.

In the example shown in FIG. 1, the mixing conduit 30 includes a generally cylindrical body held within the exhaust conduit 13 by a plate 33 or other mounting structure. Openings 37 are defined in a sidewall of the mixing conduit 30 to provide the downstream entrance(s) 35. In certain examples, louvers 38 or other structures are disposed at the openings 37 to impart rotation on the exhaust radially entering the mixing conduit 30 through the downstream entrance(s) 35, which results in a swirling flow within the mixing conduit 30.

In some implementations, the mixing conduit 30 is structured so that an interior of the mixing conduit 30 is devoid of flow impediments in longitudinal alignment with the dispersing arrangement 40. For example, the mixing conduit 30 is generally hollow, thereby allowing exhaust to flow through the mixing conduit 30 downstream of the dispersing arrangement 40 without impinging on any surface other than an inner through-passage surface of the mixing conduit 30.

Figure 2:
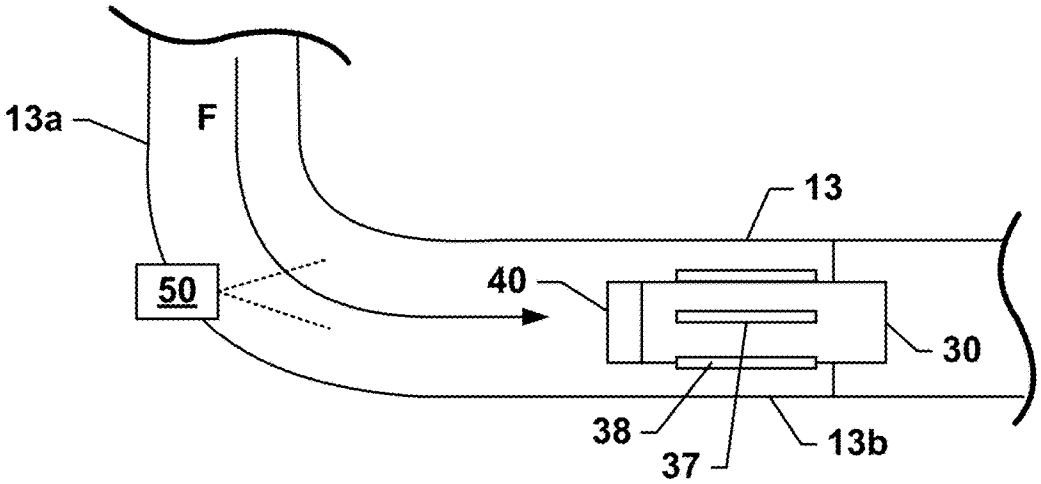
FIG. 2 is a schematic view of a mixing conduit disposed within an exhaust conduit having an injector mounted at an elbow joint upstream of the mixing conduit.

As shown in FIG. 2, an injector 50 is disposed upstream of the mixing conduit 30 to spray reactant into the exhaust flowing through the exhaust conduit 13. The injector 50 sprays the reactant into exhaust flowing towards the mixing conduit 30. In certain implementations, the injector 50 is configured to spray reactant towards the mixing conduit 30. In an example, a spray face of the nozzle 50 aligns with a longitudinal axis of the mixing conduit 30. In another example, the spray face of the nozzle 50 aligns with the upstream face 41 of the dispersing arrangement 40. In other examples, the spray face of the nozzle 50 faces away from the dispersing arrangement 40.

In some implementations, the nozzle 50 is disposed sufficiently upstream of the dispersing arrangement 40 that a spray axis of the nozzle 50 does not intersect the upstream face 41 of the dispersing arrangement 40. Such implementations may reduce deposits of the reactants on the dispersing arrangement 40. In other implementations, the nozzle 50 is disposed so that the spray axis of the nozzle 50 intersects the upstream face 41 of the dispersing arrangement 40. Such implementations may increase the chances of breaking up droplets of the reactants. In an example, the spray axis is directed towards a center of the upstream face 41. In another example, the spray axis is directed towards a bottom of the upstream face 41.

Figure 3:
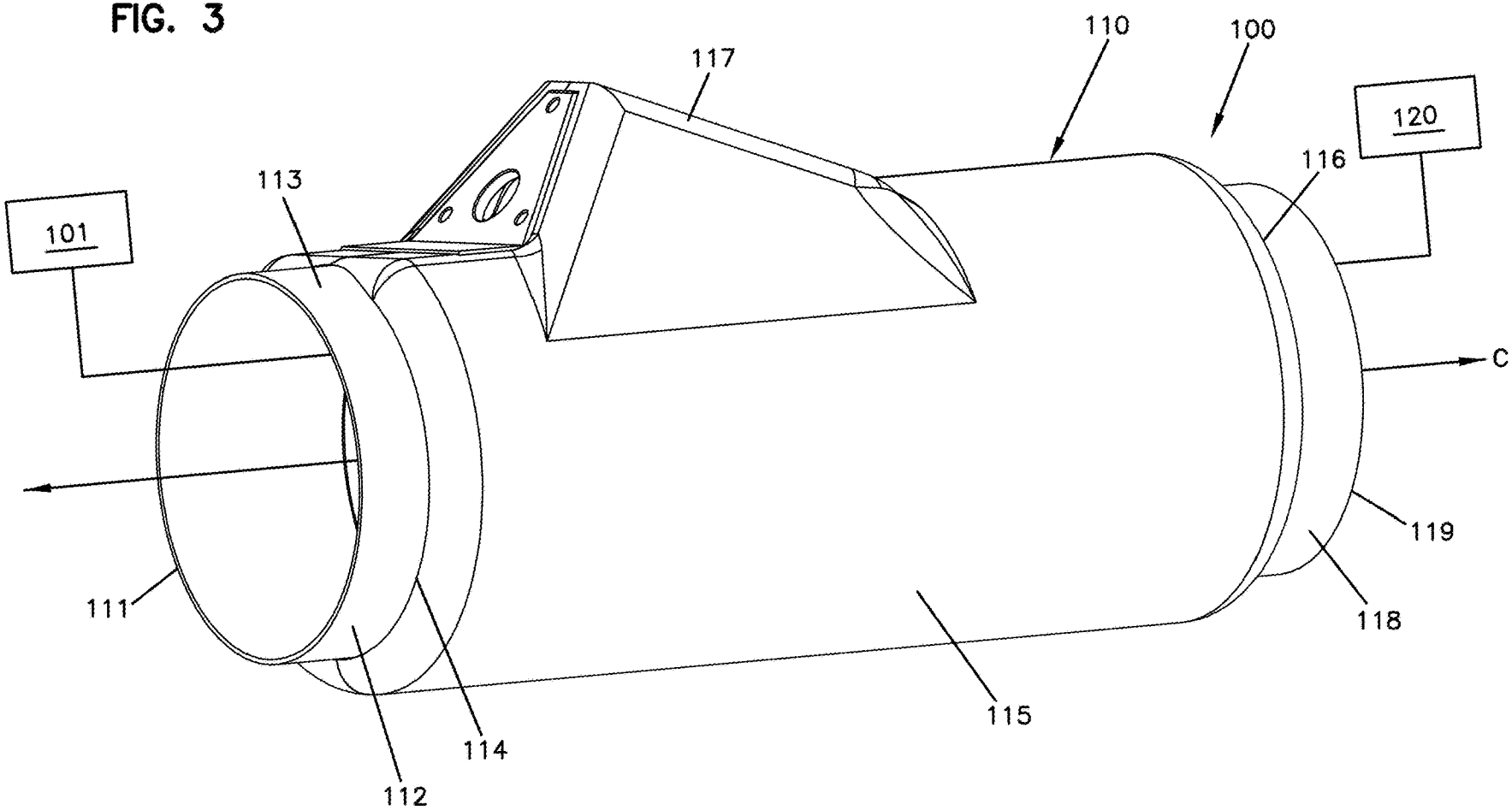
FIG. 3 is a partially schematic view of an aftertreatment system including another example dosing and mixing unit in accordance with the principles of the present disclosure.

FIG. 3 shows an exhaust aftertreatment system 100 including another example dosing and mixing unit 110 in accordance with the principles of the present disclosure. The exhaust aftertreatment system 100 includes an engine 101 from which exhaust is routed to the dosing and mixing unit 110. In an example, a flow straightener, focus nozzle, or swirl device is disposed between the engine 101 and the dosing and mixing unit 110. A dose of reactant is mixed into the exhaust at the dosing and mixing unit 110. The exhaust aftertreatment system 100 also can include a treatment substrate 120 to which the dosed and mixed exhaust is routed.

For example, the exhaust carrying the reactant can be routed to a selective catalytic reduction (SCR) catalyst device, a lean NOx catalyst, or a lean NOx trap. In some examples, the reactant can be a reductant such as urea or ammonia used in NOx reduction. In other applications, the treatment substrate 20 can include a diesel oxidation catalyst (DOC) substrate, a diesel particulate filter (DPF) substrate, and/or an SCR on Filter (SCRF). In such examples, the reactant can include a hydrocarbon that may be combusted to increase exhaust temperatures for regeneration purposes (e.g., soot combustion). Combinations of the above substrates also can be used.

The dosing and mixing unit 110 includes a housing 115 having a first end 114 and a second end 116. The housing 115 surrounds an exhaust conduit 113 having an inlet 111 and an outlet 119. In certain examples, the inlet 111 couples to an inlet pipe 112 and the outlet 119 couples to an outlet pipe 118 (see FIG. 2). In some implementations, the inlet 111 aligns with the outlet 119. In certain examples, the inlet 111 and outlet 119 align with a central axis C (FIG. 1) to form an inline dosing and mixing unit 110. Angled configurations are also contemplated. In certain implementations, the housing 115 insulates the exhaust conduit 113.

Figure 4:
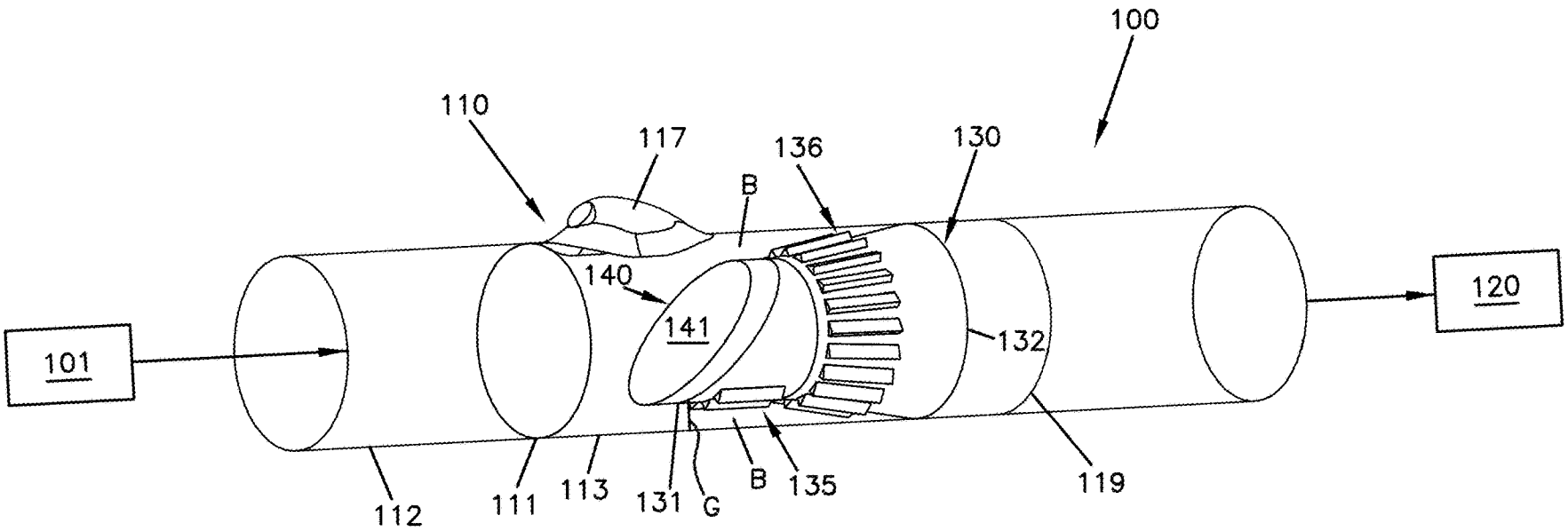
FIG. 4 is a perspective view of the dosing and mixing unit of FIG. 3 including a mixing conduit and dispersing arrangement in accordance with the principles of the present disclosure.

Another example mixing conduit 130 is disposed within the exhaust conduit 113 (FIG. 4). The mixing conduit 130 has an upstream end 131 and a downstream end 132. In certain examples, a central axis C2 (FIG. 7) of the mixing conduit 130 aligns with the central axis C (FIG. 3) of the dosing and mixing unit 110. In other examples, the central axis C2 of the mixing conduit 130 can be offset from the central axis C of the exhaust conduit 113. The mixing conduit 130 is configured to swirl exhaust passing radially through the mixing conduit 130. The exhaust swirls as the exhaust flows within of the mixing conduit 130 and continues to swirl as the exhaust flows downstream of the mixing conduit 130. In certain examples, the exhaust swirls about a longitudinal axis extending between the first and second ends 131, 132. In other implementations, the exhaust can swirl about other orientations.

Figure 5:
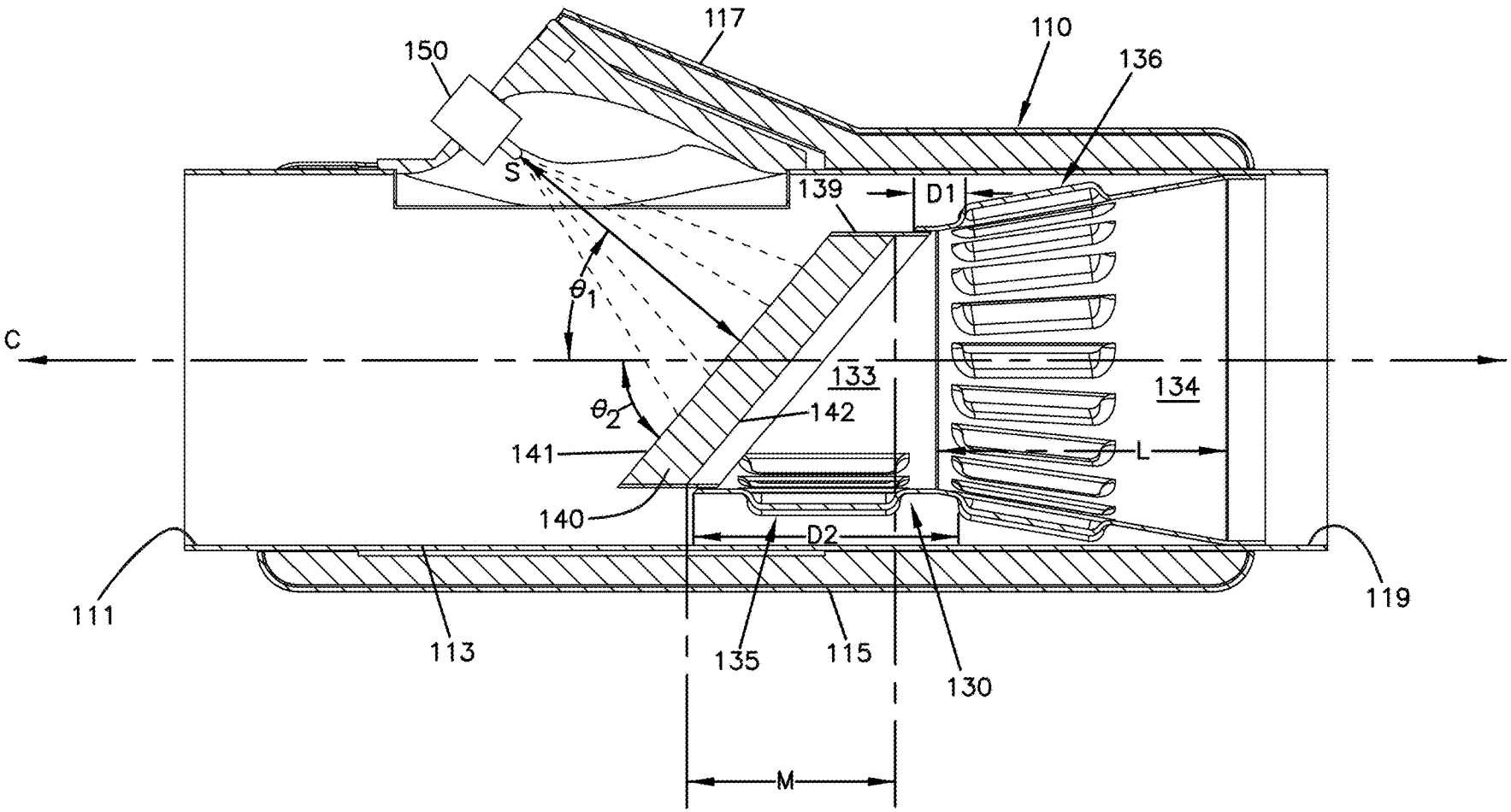
FIG. 5 is a longitudinal cross-section of the dosing and mixing unit of FIG. 3.

In some implementations, an injector 150 is disposed at the exhaust conduit 113 and oriented to spray or otherwise output reactant (e.g., urea (e.g., aqueous urea), ammonia, hydrocarbons) into exhaust flowing towards the mixing conduit 130 (see FIG. 5). For example, the injector 150 can be oriented to spray reactant towards the upstream end 131 of the mixing conduit 130. In other examples, however, the injector 150 can spray reactant away from the mixing conduit 130. In certain implementations, the exhaust conduit 113 is configured to facilitate mounting of an injector 150.

As shown in FIGS. 3 and 5, the injector 150 can be disposed at an injector mount 117 that extends across an opening in the exhaust conduit 113. In certain examples, the injector mount 117 is located at a circumferential wall of the exhaust conduit 113. In an example, the injector mount 117 is located towards the first end 114 of the housing 115. The injector 150 spray reactants from a dispensing end of the injector 150, through an opening in the exhaust conduit 113, and into the exhaust conduit 113. In some implementations, the injector mount 117 is configured to mount the injector 150 at the angle $\theta_1$ relative to the central axis C of the exhaust conduit 113. In other implementations, the injector 150 can be mounted in line with the central axis C (e.g., see FIG. 2).

In some implementations, the mixing conduit 130 also includes a dispersing arrangement 140 through which at least some exhaust flow enters the mixing conduit 130. In certain implementations, the injector 150 is oriented to spray the reactant towards the dispersing arrangement 140. The dispersing arrangement 140 is configured to break-up droplets of reactant sprayed from the injector 150 to facilitate mixing of the reactant with the exhaust flowing through the mixing conduit 130. In certain implementations, the dispersing arrangement 140 is disposed at the upstream end 131 of the mixing conduit 130. In certain examples, flow passing through the dispersing arrangement 140 axially enters the mixing conduit 130. In an example, the flow passing through the dispersing arrangement 140 is swirling (e.g., from a swirl device disposed upstream of the dosing and mixing unit 110).

In various implementations, the dispersing arrangement 140 includes a mesh, a sponge (e.g., foam or metal), and/or a tortuous path baffle arrangement. In certain implementations, the dispersing arrangement 140 is a mesh formed from a knit, a weave, or a jumbling of one or more metal wires. Each wire is thin to facilitate heating of the wire. In an example, the metal wires have round transverse cross-sections. In other examples, the transverse cross-sections of the metal wires can have any desired shape (e.g., oblong, rectangular, square, etc.).

In certain implementations, the mesh includes wires having diameters that are 100 times smaller than an upstream end of the mixing conduit. In certain implementations, the mesh includes wires having diameters that are 1,000 times smaller than an upstream end of the mixing conduit. In certain implementations, the mesh includes wires having diameters that are 10,000 times smaller than an upstream end of the mixing conduit. In certain implementations, the mesh includes wires having diameters that are 100,000 times smaller than an upstream end of the mixing conduit. In some implementations, transverse cross-dimensions of the metal wires are no more than 0.01 inches. In certain examples, the transverse cross-dimensions of the metal wires are no more than 0.008 inches. In certain examples, the transverse cross-dimensions of the metal wires are no more than 0.007 inches. In certain examples, the transverse cross-dimensions of the metal wires are no more than 0.006 inches.

The dispersing arrangement 140 may provide heat to some reactant to aid in the vaporization process as the exhaust passes through the dispersing arrangement 140. In an example, the dispersing arrangement 140 is formed from a continuous weave of a metal wire. In an example, the dispersing arrangement 140 is formed from a continuous knit of a metal wire. In an example, the dispersing arrangement 140 is formed from stainless steel. In certain examples, the dispersing arrangement 140 is coated in $TiO_2$.

The dispersing arrangement 140 has an upstream face 141 that faces out of the mixing conduit 130 and a downstream face 142 that faces into the mixing conduit 130. In certain implementations, the upstream face 141 is centered along the central axis C of the exhaust conduit 113. In other implementations, the upstream face 141 is offset from the central axis C of the exhaust conduit 113. In some implementations, the upstream face 141 of the dispersing arrangement 140 has a non-circular profile. In an example, the upstream face 141 of the dispersing arrangement 140 has an oblong profile.

In certain examples, the area defined by the upstream face 141 of the dispersing arrangement 140 is different from a transverse, cross-sectional area of the upstream end 131 of the mixing conduit 130. In some implementations, the dispersing arrangement 140 has a cross-dimension (e.g., diameter) that is smaller than a cross-dimension (e.g., diameter) of the exhaust conduit 113. Accordingly, a circumferential gap G extends between an outer perimeter of the dispersing arrangement 140 and an inner surface of the exhaust conduit 113. In certain examples, the dispersing arrangement 140 has a larger area than the transverse, cross-sectional area of the upstream end 131 of the mixing conduit 130.

In certain implementations, a plane defined by the upstream face 141 of the dispersing arrangement 140 is oriented at a non-perpendicular angle $\theta_2$ relative to the central axis C of the exhaust conduit 113 (see FIG. 5). The angling of the upstream face 141 increases the surface area of the upstream face 141. The increase in surface area may reduce the backpressure at the upstream face 141. The angling also may enable separation between heavier and lighter droplets of reactant. In certain implementations, the upstream face 141 is oriented at an angle $\theta_2$ ranging from about 0° to about 90°. In certain implementations, the upstream face 141 is oriented at an angle $\theta_2$ ranging from about 20° to about 70°. In examples, the upstream face 141 is oriented at an angle $\theta_2$ of at least about 10°. In examples, the upstream face 141 is oriented at an angle $\theta_2$ of at least about 20°. In examples, the upstream face 141 is oriented at an angle $\theta_2$ of at least about 30°. In examples, the upstream face 141 is oriented at an angle $\theta_2$ of at least about 40°. In examples, the upstream face 141 is oriented at an angle $\theta_2$ of no more than about 90°. In examples, the upstream face 141 is oriented at an angle $\theta_2$ of no more than about 80°. In examples, the upstream face 141 is oriented at an angle $\theta_2$ of no more than about 70°. In an example, the upstream face 141 is oriented at an angle $\theta_2$ of about 45°. In an example, the upstream face 141 is oriented at an angle $\theta_2$ of about 40°. In an example, the upstream face 141 is oriented at an angle $\theta_2$ of about 50°. In an example, the upstream face 141 is oriented at an angle $\theta_2$ of about 60°.

In certain implementations, the upstream face 141 of the dispersing arrangement 140 is intersected by the spray direction S of the injector 150 (e.g., see FIG. 5). In some examples, the injector 150 is mounted to spray reactants towards a center of the upstream face 141 of the dispersing arrangement 140. In other implementations, the injector 150 is mounted to spray reactants towards a bottom of the upstream face 141 of the dispersing arrangement 140. By aiming the injector 150 towards the bottom, high exhaust flow through the exhaust conduit 113 will carry the reactants across the entire upstream face 141 of the dispersing arrangement 140. In certain implementations, the injector 150 is mounted to spray upstream of the dispersing arrangement 140, which may result in greater utilization of the dispersing arrangement 140. For example, the injector 150 can be mounted sufficiently far upstream so that the injector 150 spray does not intersect the upstream face 141. In another example, the injector 150 can be oriented to spray in an upstream direction.

In accordance with some aspects of the disclosure, a bypass B is provided between a portion of the mixing conduit 130 and the exhaust conduit 113. The bypass B extends through the circumferential gap G along a portion of the length of the mixing conduit 130 to allow exhaust to flow past the upstream end of the mixing conduit 130. In certain examples, the bypass B allows exhaust to flow past the dispersing arrangement 140. In certain implementations, the bypass B provides an annular passage through which exhaust can enter the mixing conduit 130 downstream of the dispersing arrangement 140.

The dispersing arrangement 140 reduces the flow rate of the exhaust entering the mixing conduit 130 through the upstream end 131 of the mixing conduit 130. In certain examples, the angled upstream face 141 of the dispersing arrangement 140 mitigates some of the backpressure. In certain examples, the bypass B mitigates backpressure by enabling exhaust to flow around the dispersing arrangement 140 instead of through the dispersing arrangement 40 (e.g., see FIGS. 4 and 6). In other examples, the bypass B enables the exhaust to flow around a portion (e.g., a thicker portion) of the dispersing arrangement 140, but not the entire dispersing arrangement 140.

Exhaust flowing along the bypass B thermally insulates (at least partially) the mixing conduit 130 from the exhaust conduit 113. For example, heated exhaust flowing along the bypass B may thermally insulate the upstream end 131 of the mixing conduit 130 from a cooler inner wall of the exhaust conduit 113. In an example, the exhaust flowing along the bypass B thermally insulates the dispersing arrangement 140. Thermally insulating the upstream end 131 of the mixing conduit 130 and/or the dispersing arrangement 140 mitigates heat loss at these areas. Accordingly, the bypass B facilitates vaporization of the reactant by keeping the upstream end 131 of the mixing conduit 130 and/or the dispersing arrangement 140 at a higher temperature than if these areas contacted the exhaust conduit 113.

The bypass B leads to one or more downstream entrances into the mixing conduit 130. At least some of the exhaust that does not enter the mixing conduit 130 through the dispersing arrangement 140 can instead enter the mixing conduit 130 at the downstream entrances. For example, in some implementations, the sidewall of the mixing conduit 130 defines a first radial flow entry region 135 at which exhaust can flow from the bypass B into the interior of the mixing conduit 130. One or more apertures 137 are provided at the first radial flow entry region 135 to enable exhaust to flow into the mixing conduit 130. In certain examples, structure (e.g., one or more louvers 138 or baffles) can be provided at the first radial flow entry region 135 to impart rotation (e.g., swirling) to the flow passing through the first radial flow entry region 135.

Figure 6:
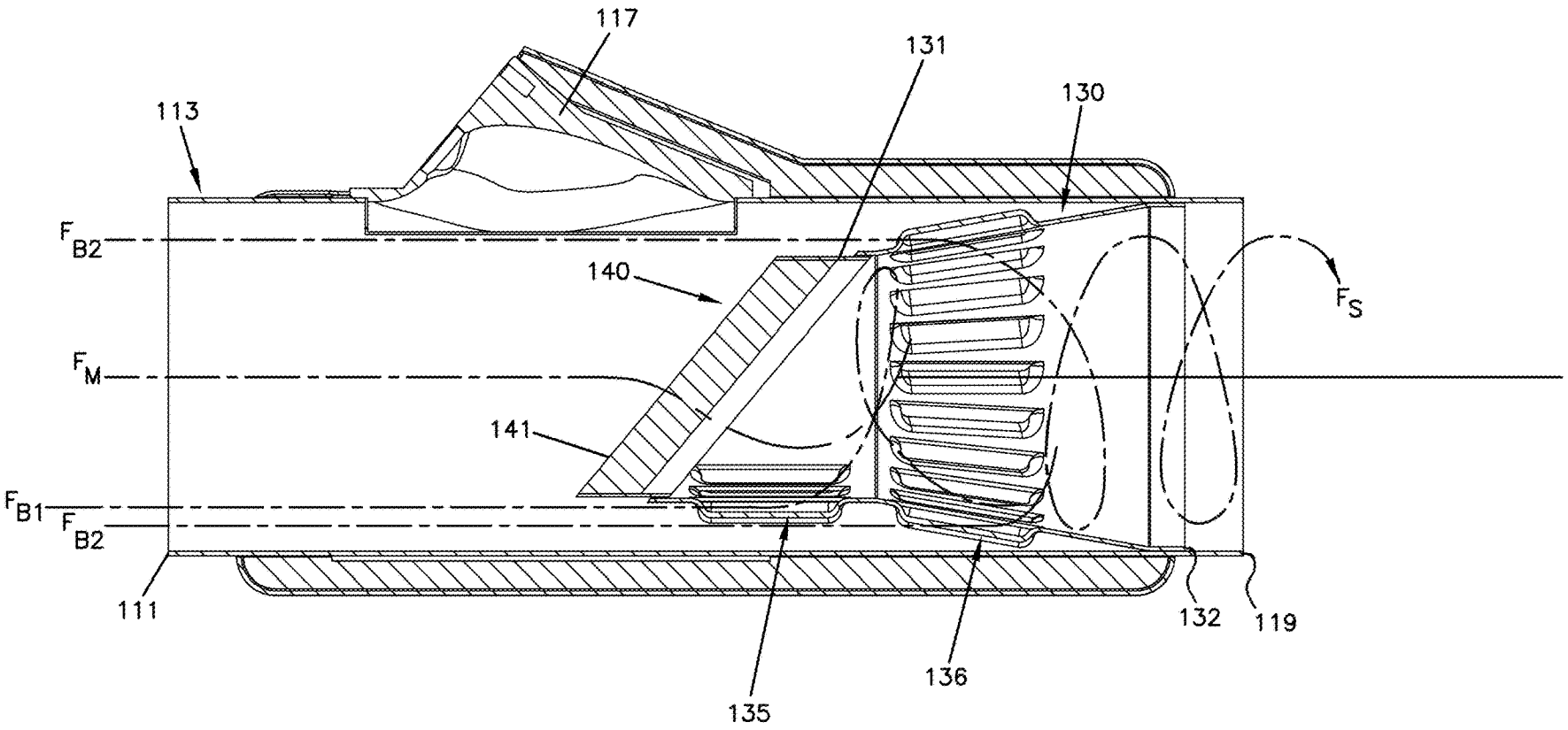
FIG. 6 illustrates flow paths extending through the dosing and mixing unit of FIG. 3.

The first radial flow entry region 135 is positioned so that exhaust entering the mixing conduit 130 through the first radial flow entry region 135 entrains reactant passing through the dispersing arrangement 140 to inhibit deposition of the reactant on a lower inner surface of the mixing conduit 130 (e.g., see FIGS. 4 and 6). In certain examples, the first radial flow entry region 135 is disposed along the spray direction S of the injector 150. The first radial flow entry region 135 may be provided at a bottom of the mixing conduit 130 so that exhaust entering the mixing conduit 130 through the first radial flow entry 135 carries the reactants upwardly away from the bottom of the mixing conduit 130.

The first radial flow entry region 135 is disposed at a location spaced (e.g., along the central axis C) from the upstream end 131 of the mixing conduit 130. In certain examples, the first radial flow entry region 135 is disposed at or immediately downstream of the dispersing arrangement 140. In certain examples, at least a portion of the first radial flow entry region 135 overlaps at least a portion of the dispersing arrangement 140 as the first radial flow entry region 135 extends along the central axis C of the exhaust conduit 113. In certain examples, a majority of the first radial flow entry region 135 overlaps at least a portion of the dispersing arrangement 140 as the first radial flow entry region 135 extends along the central axis C of the exhaust conduit 113. In an example, a majority of the first radial flow entry region 135 overlaps a majority of the dispersing arrangement 140 as the first radial flow entry region 135 extends along the central axis C of the exhaust conduit 113. The downstream face 142 of the dispersing arrangement 140 extends a distance M (FIG. 5) along the central axis C of the exhaust conduit 113. In certain examples, each aperture 137 of the first flow entry region 135 extends across a majority of the distance M (e.g., see FIG. 5).

In some implementations, a second radial flow entry region 136 can be provided at the sidewall of the mixing conduit 130 at a location spaced downstream of the first radial flow entry region 135 (e.g., see FIGS. 4 and 6). One or more apertures 137 are provided at the second radial flow entry region 136 to enable exhaust to flow into the mixing conduit 130. In certain examples, one or more louvers or baffles 138 can be provided at the second radial flow entry region 136. The louver(s) or baffle(s) 138 can impart a rotation to the exhaust as the exhaust enters the mixing conduit 130 through the aperture(s) 137. For example, the louvers or baffles 138 can cause the exhaust to swirl or otherwise mix together with the axially flowing exhaust that entered through the dispersing arrangement 140. In an example, the second radial flow entry region 136 extends around a full circumference of the mixing conduit 130. In an example, the second radial flow entry region 136 is located at or near the downstream end of the mixing conduit 130. In other implementations, the mixing conduit 130 only includes the second radial flow entry region 136.

In some implementations, the louvers 138 at the second radial flow entry region 136 are smaller than the louvers 138 at the first radial flow entry region 135. In other implementations, the louvers 138 at the second radial flow entry region 136 are the same size as the louvers 138 at the first radial flow entry region 135. In still other implementations, the louvers 138 at the second radial flow entry region 136 are larger than the louvers 138 at the first radial flow entry region 135.

FIG. 6 illustrates various possible flow paths FM, FB1, and FB2 that exhaust can follow as the exhaust flows from the inlet 111 of the exhaust conduit 113 to the outlet 119 of the exhaust conduit 113. A first flow path FM enters the mixing conduit 130 via the dispersing arrangement 140 at the upstream end 131 of the mixing conduit 130, passes through the mixing conduit 130, and exits the mixing conduit 130 at the downstream end 132 of the mixing conduit 130.

A first bypass flow path FB1 extends past the dispersing arrangement 140 and through the bypass B at the exterior of the mixing conduit 130 until reaching the first radial flow entry region 135 of the mixing conduit 130. The first bypass flow path FB1 enters the mixing conduit 130 at the first radial flow entry region 135, flows through the mixing conduit 130, and exits the mixing conduit 130 at the downstream end 132 of the mixing conduit 130. In certain examples, a second bypass flow path FB2 extends past the dispersing arrangement 140 and through the bypass B at an exterior of the mixing conduit 130 until reaching the second radial flow entry region 136. The second bypass flow path FB2 enters the mixing conduit 130 at the second bypass region 136, flows through the mixing conduit 130, and exits the mixing conduit 130 at the downstream end 132 of the mixing conduit 130. In an example, the second bypass flow path FB2 extends past the first radial flow entry region 135 before reaching the second radial flow entry region 136.

In some implementations, the first bypass flow path FB1 inhibits reactant that pass through the dispersing arrangement 140 from adhering to an inner surface (e.g., a bottom inner surface) of the mixing conduit 130. In certain implementations, the first bypass flow path FB1 inhibits reactant passing through the dispersing arrangement 140 from contacting an inner surface of the mixing conduit 130. For example, in the absence of the first radial flow entry region 135, droplets of reactant may gravitate towards a bottom surface of the mixing conduit 130 after passing through the dispersing arrangement 140. Exhaust flowing through the first radial flow entry region 135 (i.e., along the first bypass flow path FB1) entrains and carries the reactant away from the bottom surface and towards the downstream end 132 of the mixing conduit 130.

In some implementations, the first and/or second radial flow entry region 135, 136 include structure that imparts swirling or other directional movement on the exhaust entering the mixing conduit 130. In certain implementations, the swirling exhaust from the first radial flow entry region 135 entrains the exhaust entering the mixing conduit 130 along the first flow path FM. In certain implementations, the swirling exhaust from the second radial flow entry region 136 entrains the exhaust entering the mixing conduit 130 along the first flow path FM. In certain implementations, the swirling exhaust from both the first radial flow entry region 135 and the second radial flow entry region 136 entrains the exhaust entering the mixing conduit 130 along the first flow path FM. In an example, the flow paths FM, FB1, and FB2 generally combine into a swirling flow path FS downstream of the flow entry regions 135, 136 (e.g., see FIG. 6). In certain implementations, some of the exhaust swirls at a greater or lesser rate than other of the exhaust.

Figure 7:
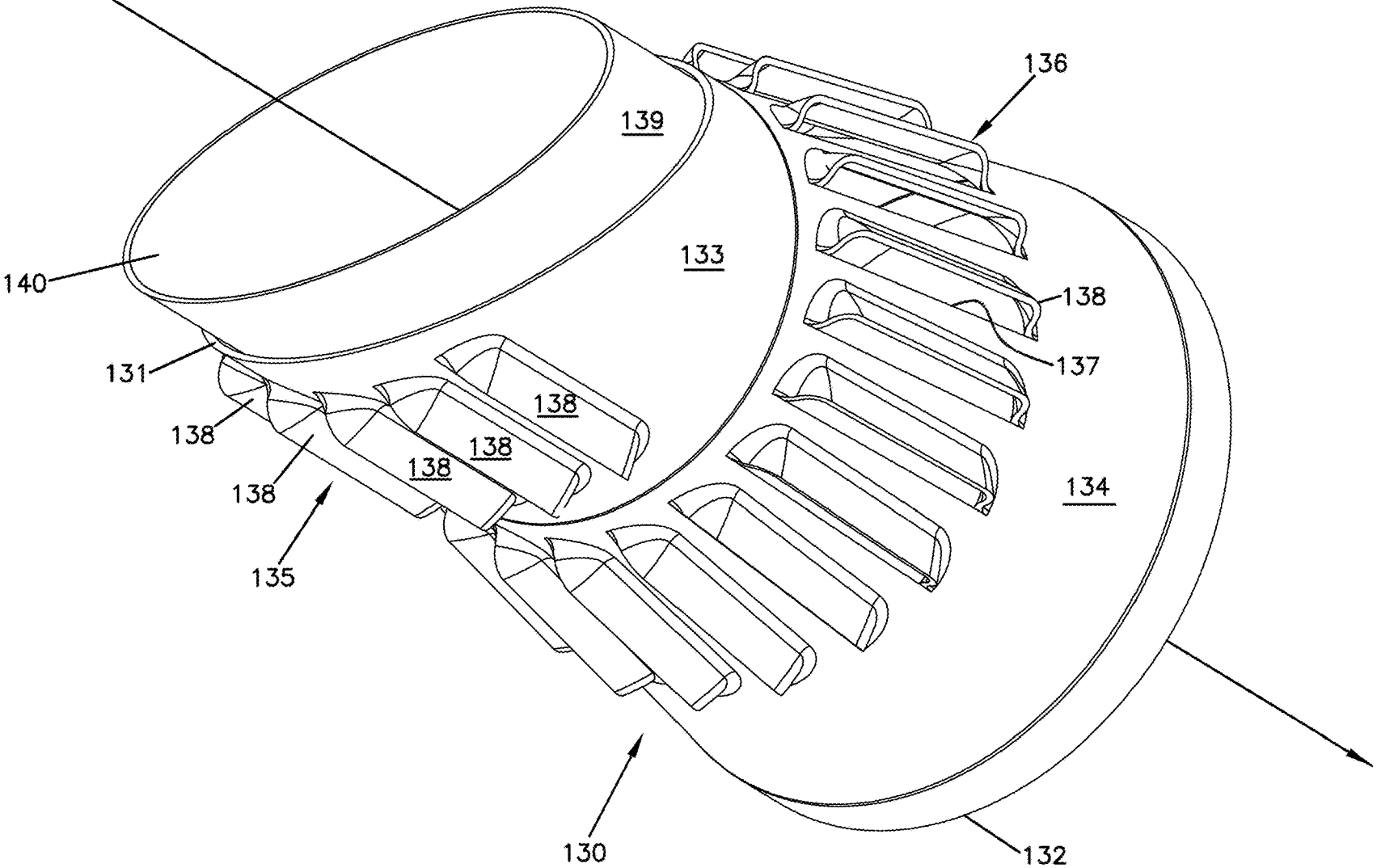
FIG. 7 is a first perspective view of the mixing conduit and dispersing arrangement of FIG. 4.
Figure 8:
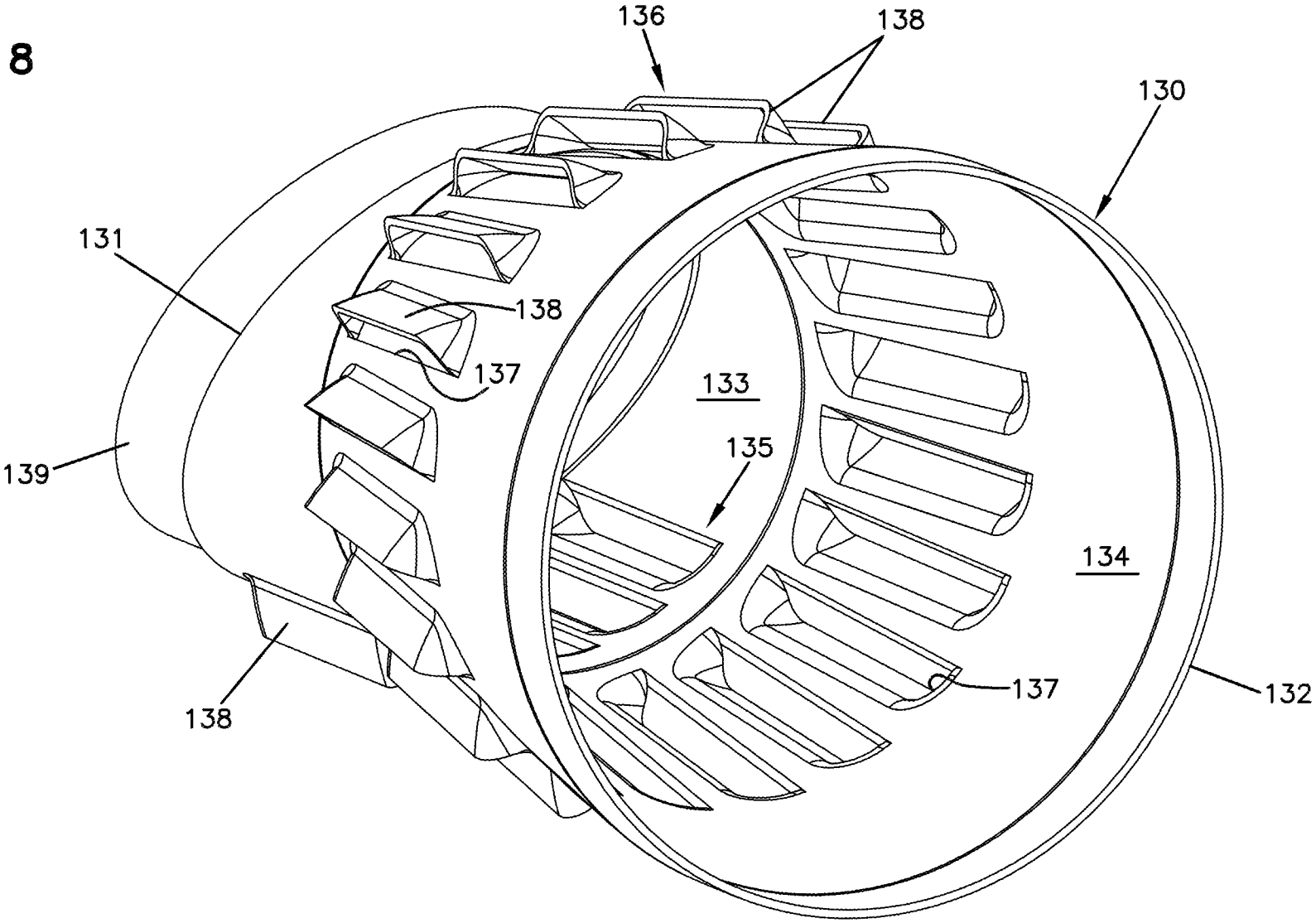
FIG. 8 is a second perspective view of the mixing conduit and dispersing arrangement of FIG. 4.

FIGS. 7 and 8 illustrate one example mixing conduit 130 suitable for use in the mixing and dosing unit 111 described above. The mixing conduit 130 extends from the upstream end 131 to the downstream end 132 and defines a hollow interior. The mixing conduit 130 includes a first section 133 towards the upstream end 131 and a second section 134 towards the downstream end 132. The first section 133 is sized to fit within the exhaust conduit 113 without contacting an inner surface of the exhaust conduit 113. The second section 134 is configured to be coupled to the exhaust conduit 113 to hold the mixing conduit 130 at a fixed position within the exhaust conduit 113. At least a portion of the second section 134 is sized to contact the inner surface of the exhaust conduit 113.

The first section 133 is sized to provide the bypass B between the mixing conduit 130 and the exhaust conduit 113 for allowing exhaust to bypass the dispersing arrangement 140. In certain examples, the first section 133 may define the first radial flow entry region 135. In certain examples, the second section 134 defines the second radial flow entry region 136 through which at least some of the exhaust may enter the mixing conduit 130. Exhaust flowing past the dispersing arrangement 140 follows the bypass B to one of the flow entry regions 135, 136.

In some implementations, the second section 134 of the mixing conduit 130 includes a truncated conical portion that tapers outwardly from a minor cross-dimension (e.g., diameter) to a major cross-dimension (e.g., diameter). The major cross-dimension defines the downstream end 132 of the mixing conduit 130. The downstream end 132 is positioned at an inner surface of the exhaust conduit 113. In some implementations, the first section 133 includes a cylindrical portion that extends from the upstream end 131 of the mixing conduit 130 to the minor cross-dimension of the truncated conical portion 134.

One or both flow entry regions 135, 136 of the mixing conduit 130 define one or more apertures 137 leading between an exterior of the mixing conduit 130 and the interior of the mixing conduit 130. The apertures 137 enable exhaust to pass from the bypass B at the exterior of the mixing conduit 130 to the interior of the mixing conduit 130. In certain implementations, the apertures 137 are elongated in directions extending generally between the first and second ends 131, 132 of the mixing conduit 130. In certain examples, the apertures 137 extend around no more than half the circumference of the mixing conduit 130 at the first flow entry region 135. In certain examples, the apertures 137 extend fully around the circumference of the mixing conduit 130 at the second flow entry region 136.

In certain implementations, the mixing conduit 130 also includes louvers 138 or other baffles disposed adjacent at least some of the apertures 137 to aid in directing flow through the apertures 137. In certain implementations, the louvers 138 impart rotation to exhaust flowing through the apertures 137. In certain examples, the louvers 138 direct the flow into a swirling flow path within the mixing conduit 130. In some implementations, the louvers 138 extend outwardly from the mixing conduit 130. In certain implementations, the louvers 138 are radially spaced from the mixing conduit 130. In other implementations, the louvers 138 extend inwardly from the mixing conduit 130.

In the example shown, each aperture 137 has a corresponding louver 138. In other implementations, only some of the apertures 137 have corresponding louvers 138. In certain examples, louvers 138 are provided at the first flow entry region 135. In certain examples, between two and fifteen louvers are provided at the first flow entry region 135. In certain examples, between six and twelve louvers are provided at the first flow entry region 135. In an example, about ten louvers are provided at the first flow entry region 135. In certain examples, louvers 138 are provided at the second flow entry region 136. In some examples, the louvers 138 of the first flow entry region 135 face in a common direction to the louvers 138 of the second flow entry region 136 (e.g., see FIG. 7). In other examples, the louvers 138 of the first flow entry region 135 face in a different direction than the louvers 138 of the second flow entry region 136 (e.g., see FIG. 23).

In some implementations, the louvers 138 of the first and second flow entry regions 135, 136 are oriented at about the same angle relative to the sidewall of the mixing conduit 130. In other implementations, the louvers 138 of the first flow entry region 135 have a more acute angle than the louvers 138 of the second flow entry region 136. In still other implementations, the louvers 138 of the first flow entry region 135 have a less acute angle than the louvers 138 of the second flow entry region 136. In certain implementations, the louvers 138 within the first flow entry region 135 can be oriented at different angles. In certain implementations, the louvers 138 within the second flow entry region 136 can be oriented at different angles.

In certain examples, the apertures 137 of the first flow entry region 135 extend over less than a circumference of the first section 133. In certain examples, the apertures 137 of the first flow entry region 135 extend over less than half the circumference of the first section 133. In certain examples, the apertures 137 of the first flow entry region 135 extend over less than a third the circumference of the first section 133. In certain examples, the apertures 137 of the first flow entry region 135 are oriented parallel to the central axis C2 of the mixing conduit 130.

In certain examples, each aperture 137 of the second flow entry region 136 extends across a majority of a length L (FIG. 3) of the second section 134. In certain examples, the second flow entry region 136 extends fully around a circumference of the second section 134. In other examples, the second flow entry region 136 may extend over less than the full circumference of the second section 134. In certain examples, the apertures 137 of the second flow entry region 136 are not oriented parallel to the central axis C2 of the mixing conduit 130. Rather, the apertures 137 are defined through a circumferential surface of a truncated cone. In certain examples, the second flow entry region 136 is located closer to the first section 133 than to the downstream end 132 of the mixing conduit 130.

In certain examples, the upstream end 131 of the mixing conduit 130 does not lie in a plane perpendicular to the central axis C of the exhaust conduit 113. For example, the first section 133 of the mixing conduit 130 may define a mitered upstream end 131. In certain examples, the first section 133 has a first length D1 at a first circumferential location and has a second length D2 at a second circumferential location. The second length D2 is longer than the first length D1 so that a reference plane extending across the upstream end 131 is oriented at a non-perpendicular angle relative to the central axis C of the exhaust conduit 113. In an example, the second length D2 is at least twice the first length D1. In an example, the second length D2 is at least three times the first length D1. In certain examples, the area defined by the upstream end 131 is oblong. In certain examples, each aperture 137 of the first flow entry region 135 extends across a majority of second length D2 of the first section 133 (e.g., see FIG. 3).

The dispersing arrangement 140 is mounted to the upstream end 131 of the mixing conduit 130. In some implementations, the dispersing arrangement 140 is mounted directly to the upstream end 131 of the mixing conduit 130. In other implementations, the dispersing arrangement 140 is held by a dispersing arrangement mounting component 139 that is configured to mount to the upstream end 131 of the mixing conduit 130. For example, the dispersing arrangement mounting component 139 may extend partially into the mixing conduit 130 at the upstream end 131. In the example shown, the dispersing arrangement mounting component 139 disposes the dispersing arrangement 140 outside of the mixing conduit 130 (e.g., the downstream face 142 is disposed outside of the mixing conduit 130). In other examples, at least part of the dispersing arrangement 140 can be disposed within the mixing conduit 130. In other implementations, the dispersing arrangement 140 is wholly disposed within the mixing conduit 130 (e.g., at the first section 133 of the mixing conduit 130).

In some implementations, the mixing conduit 130 is structured so that an interior of the mixing conduit 130 is devoid of flow impediments in longitudinal alignment with the dispersing arrangement 140, thereby allowing exhaust to flow through the mixing conduit 130 downstream of the dispersing arrangement 140 without impinging on any surface other than an inner through-passage surface of the mixing conduit 130. For example, in certain implementations, the mixing conduit 130 is generally hollow. In certain examples, the louvers 138 extend outwardly from the mixing conduit 130 and not into an interior of the mixing conduit 130. In certain examples, a cross-dimension (e.g., diameter) of the mixing conduit 130 is not reduced downstream of the dispersing arrangement 140. In the example shown, the cross-dimension of the mixing conduit 130 increases as the mixing conduit 130 extends downstream of the dispersing arrangement 140. In other examples, the cross-dimension of the mixing conduit 130 may remain constant downstream of the dispersing arrangement 140.

Figure 23:
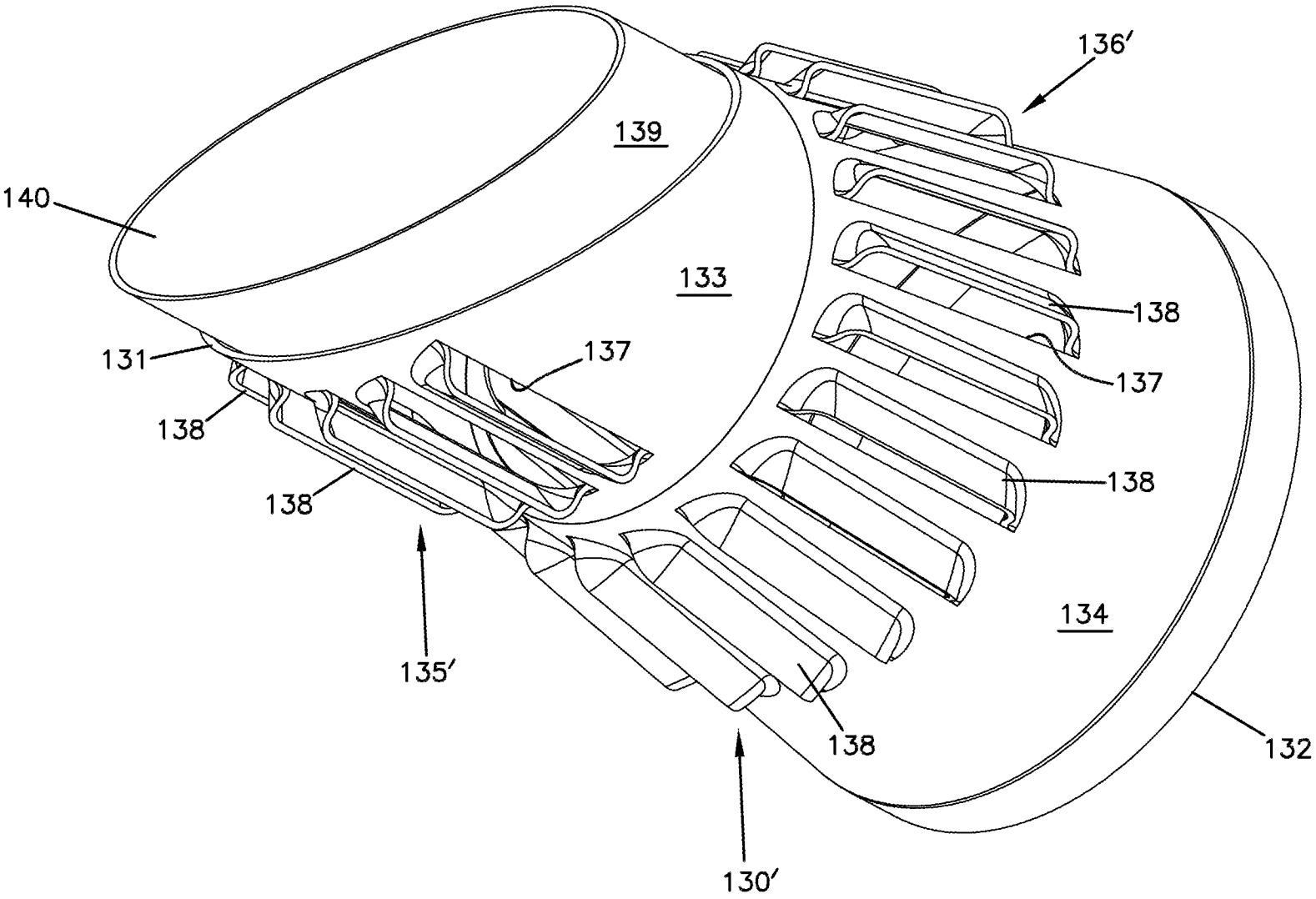
FIG. 23 is a perspective view of another mixing conduit and dispersing arrangement in accordance with the principles of the present disclosure.

FIG. 23 illustrates another example mixing conduit 130' suitable for use in the mixing and dosing unit 111 described above. The mixing conduit 130' is substantially the same as the mixing conduit 130, except that the louvers 138 of the first flow entry region 135' face in a different direction than the louvers 138 of the second flow entry region 136'. The louvers 138 of the first flow entry region 135' of the mixing conduit 130' face in a first direction that has a first circumferential component and the louvers 138 of the second flow entry region 136' of the mixing conduit 130' face in a second direction that has a second circumferential component. In an example, the second circumferential component is opposite the first circumferential component. The different circumferential components of the louvers 138 may enhance mixing within the mixing conduit 130' (e.g., by increasing bulk turbulence within the mixing conduit) and/or may aid evaporation of the reductant.

Figure 9:
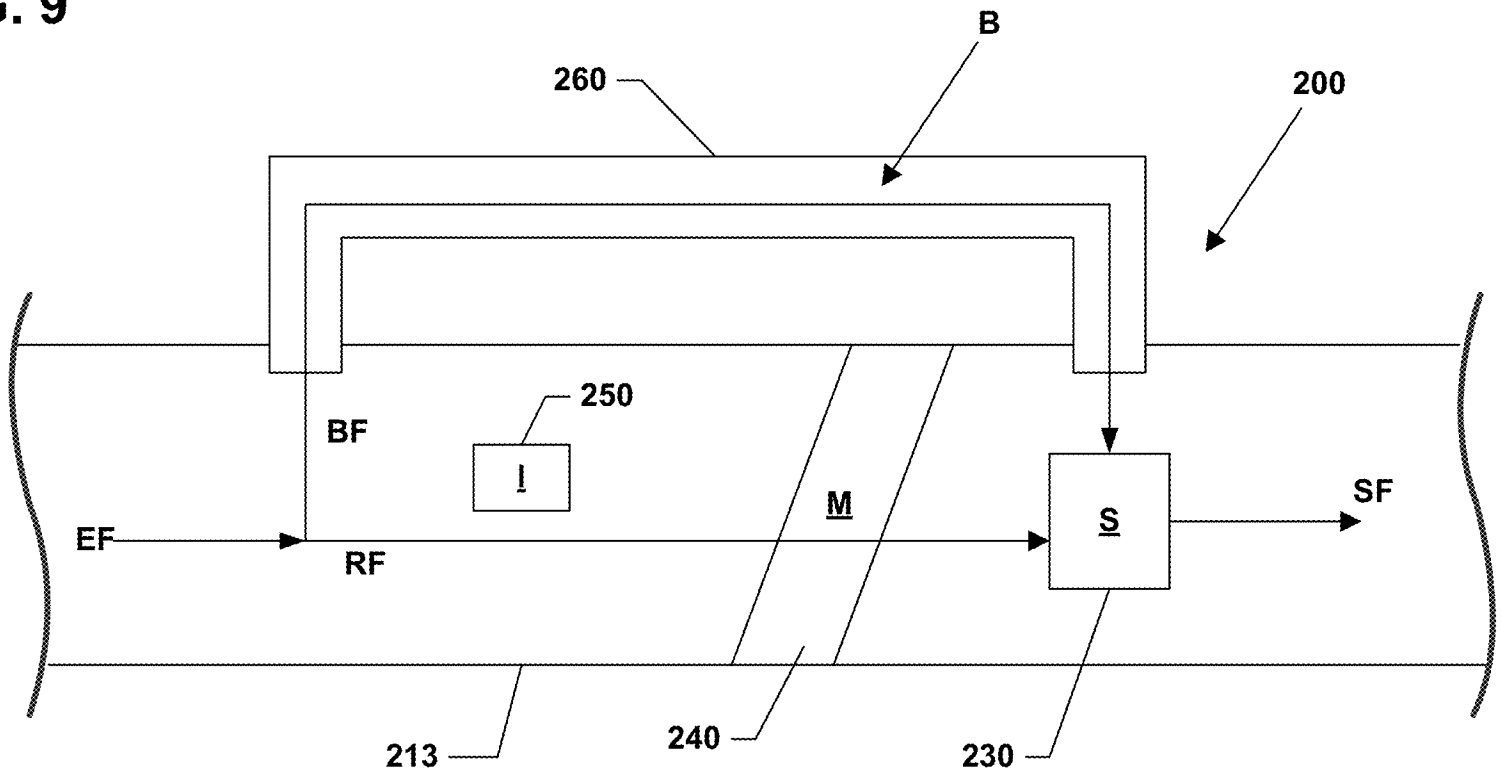
FIG. 9 is a schematic diagram of another example dosing and mixing unit having a bypass in accordance with aspects of the disclosure.
Figure 10:
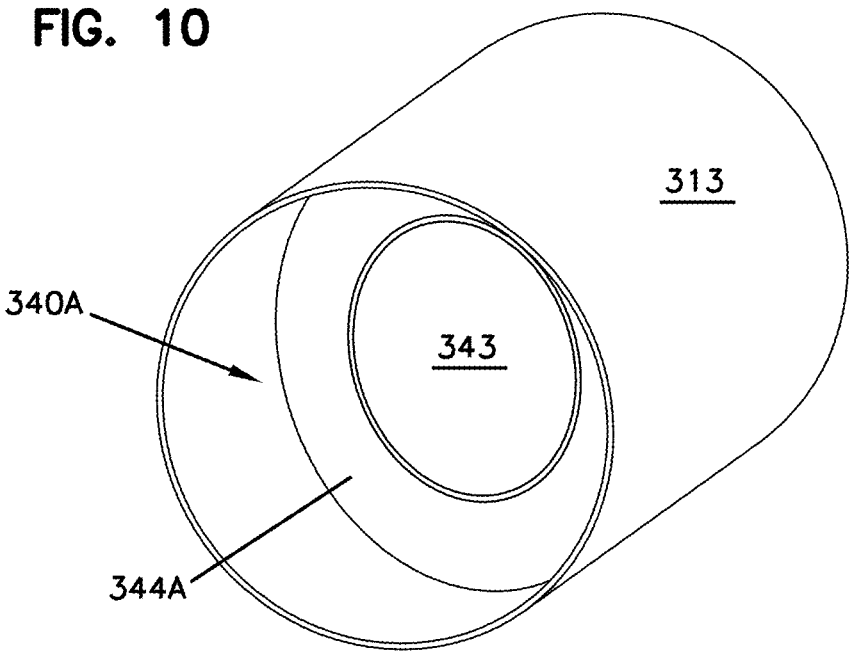
FIGS. 10-12 illustrate an example dispersing arrangement including a first region and a second region that cooperate to fully extend across the exhaust conduit.
Figure 11:
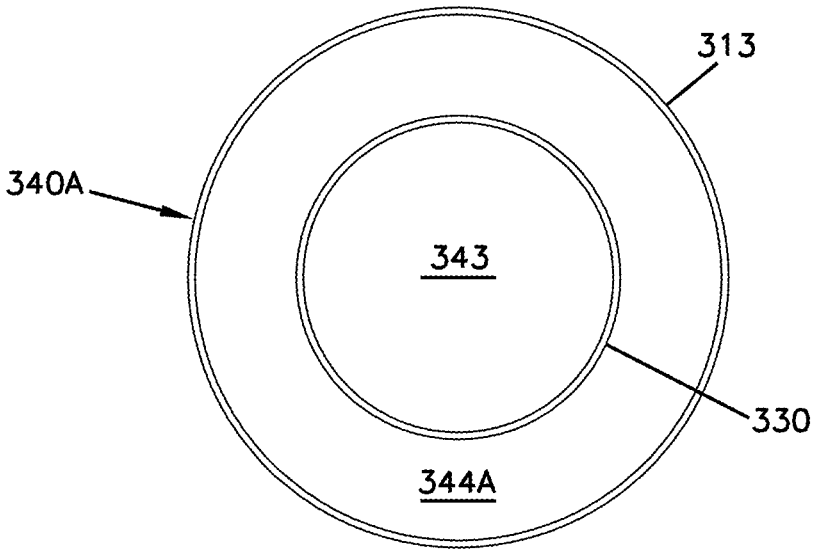
Figure 12:
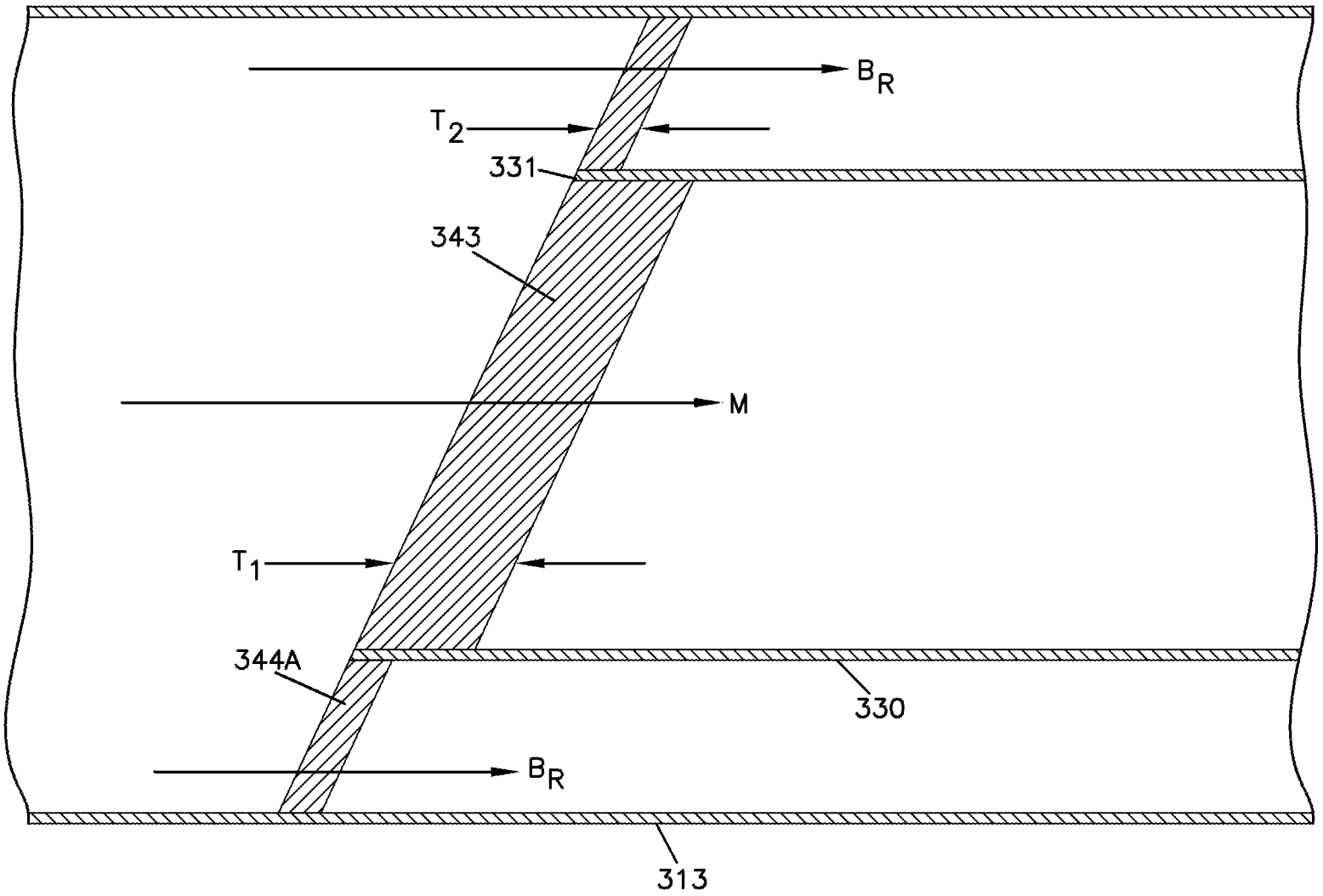
Figure 13:
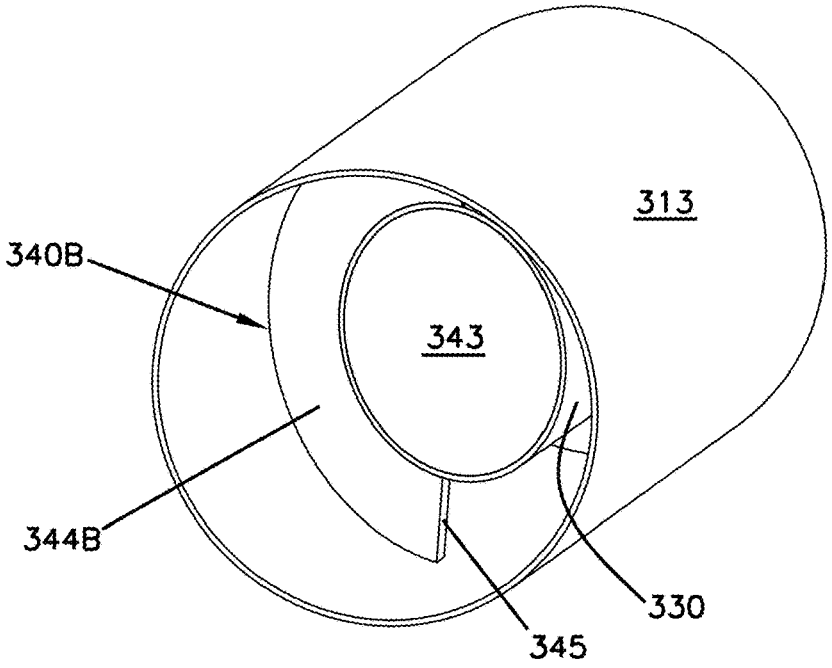
FIGS. 13-15 illustrate an example dispersing arrangement including a first region providing access to the mixing conduit interior, a second region providing restricted access to a bypass, and an opening providing unrestricted access to the bypass.
Figure 14:
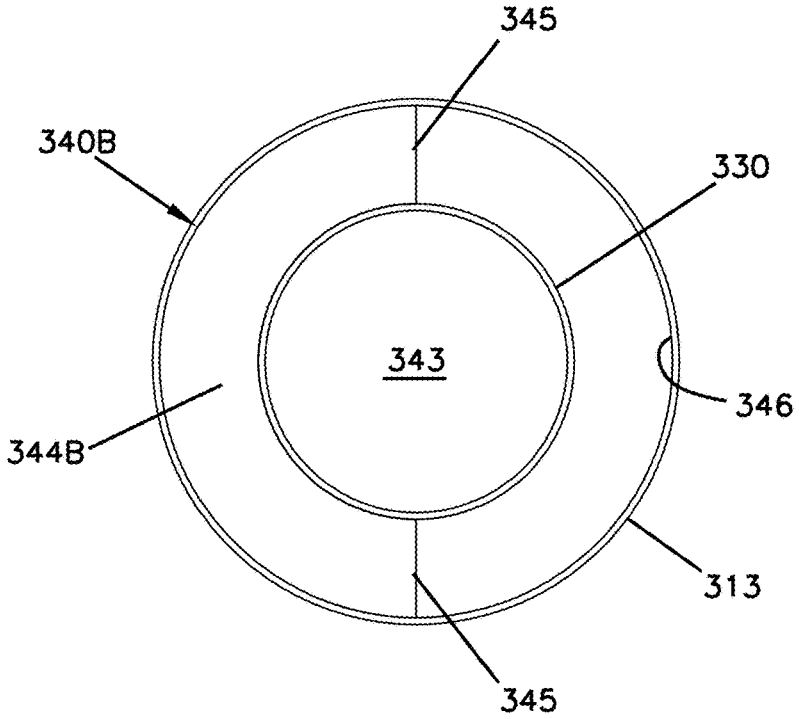
Figure 15:
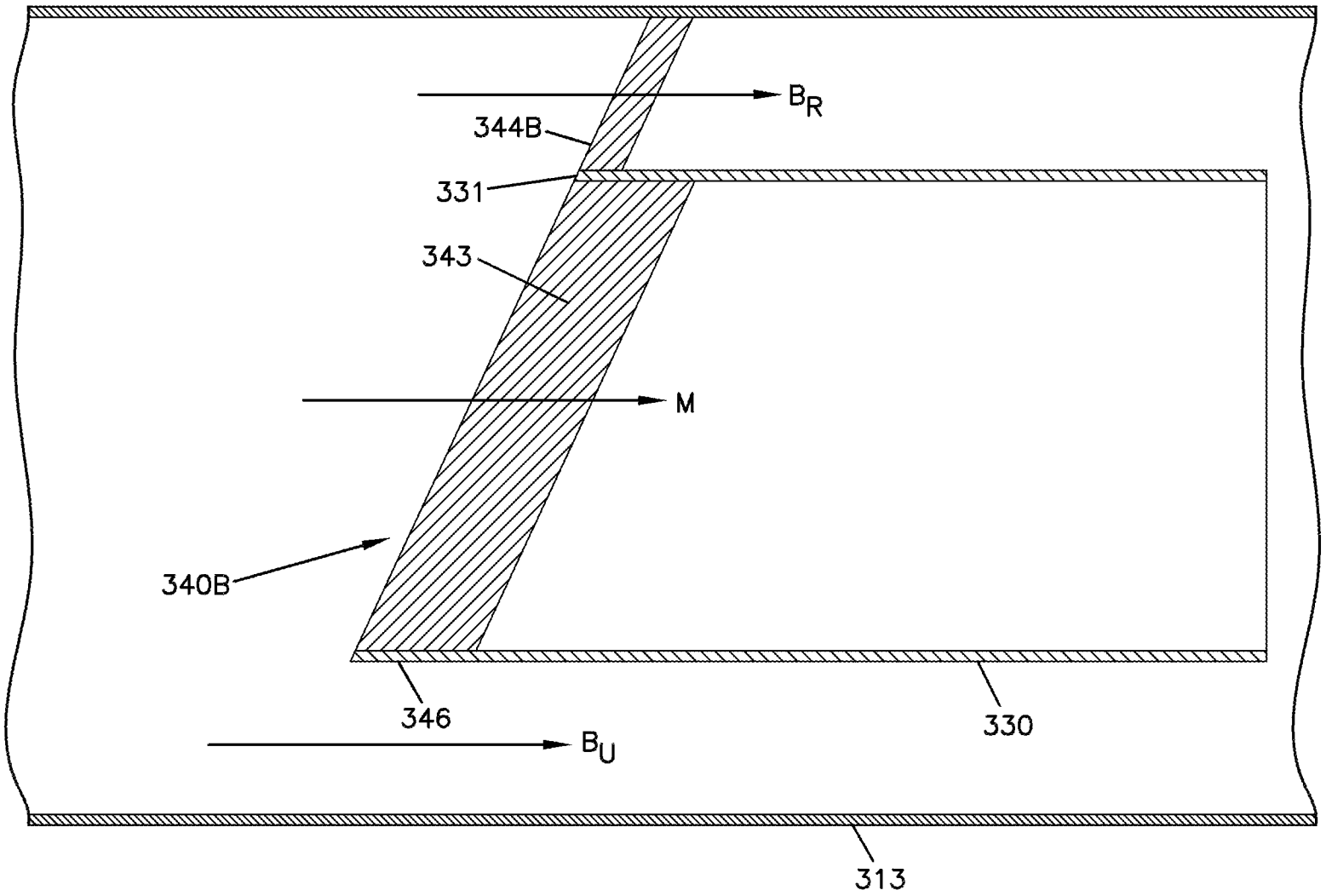
Figure 16:
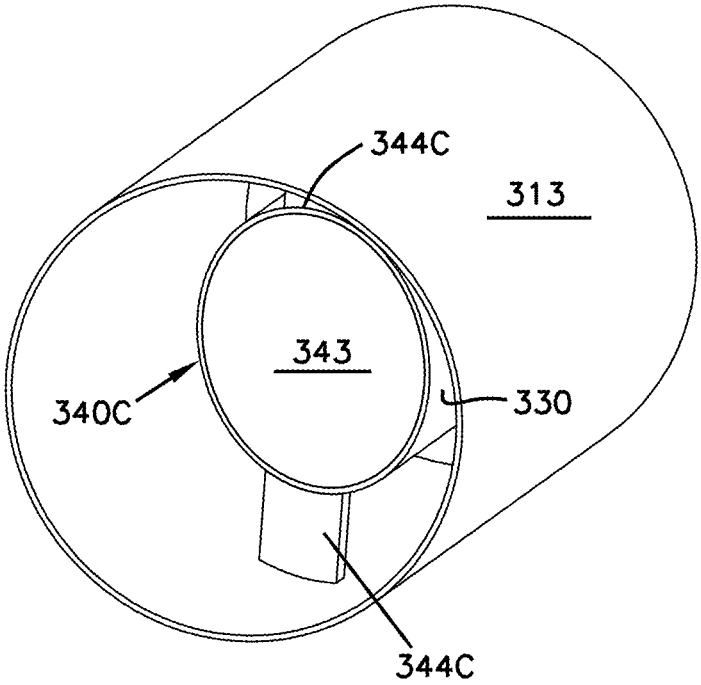
FIGS. 16-18 illustrate an example dispersing arrangement including a first region providing access to the mixing conduit interior, a second region providing restricted access to a bypass, and multiple openings providing unrestricted access to the bypass.
Figure 17:
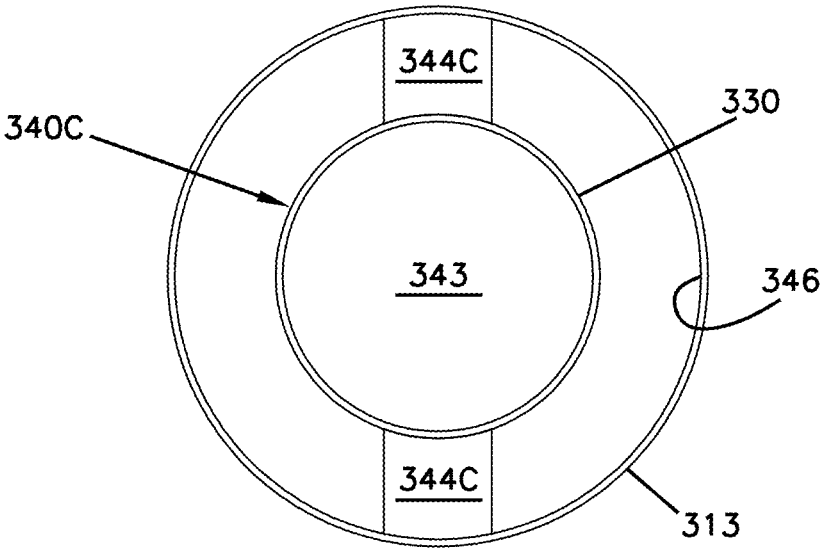
Figure 18:
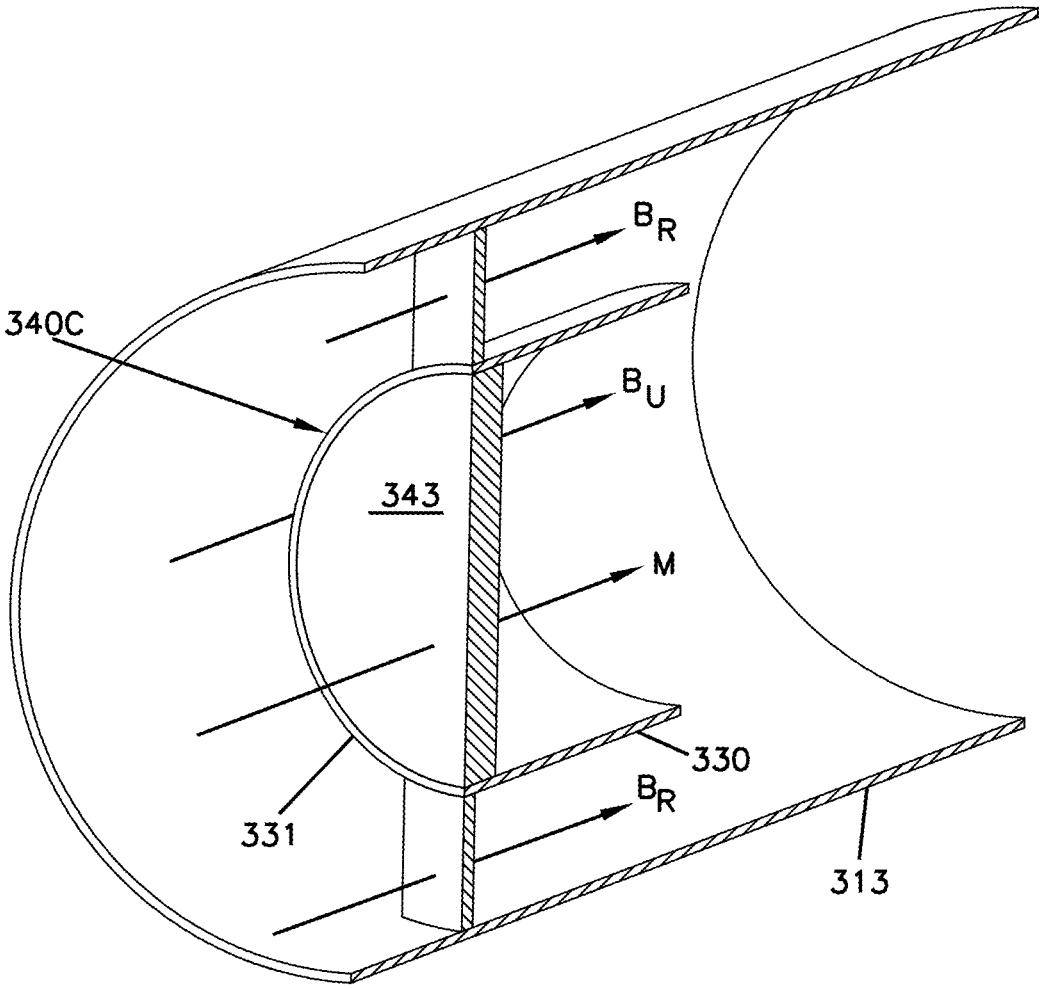
Figure 19:
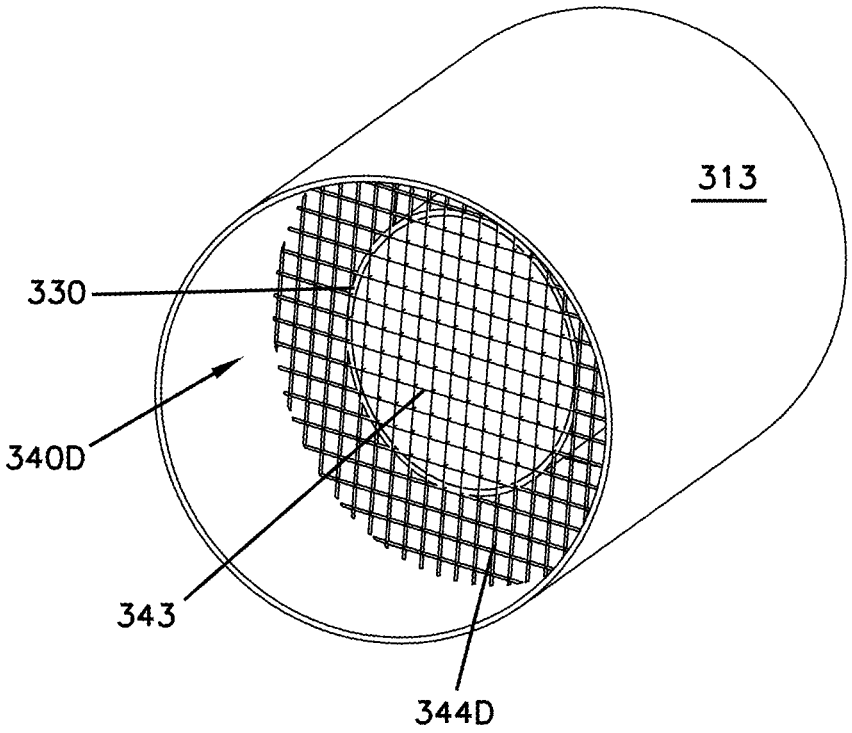
FIGS. 19-21 illustrate an example dispersing arrangement including a dispersing mesh at a first region and a second mesh that restricts access to the first region and to the bypass.
Figure 20:
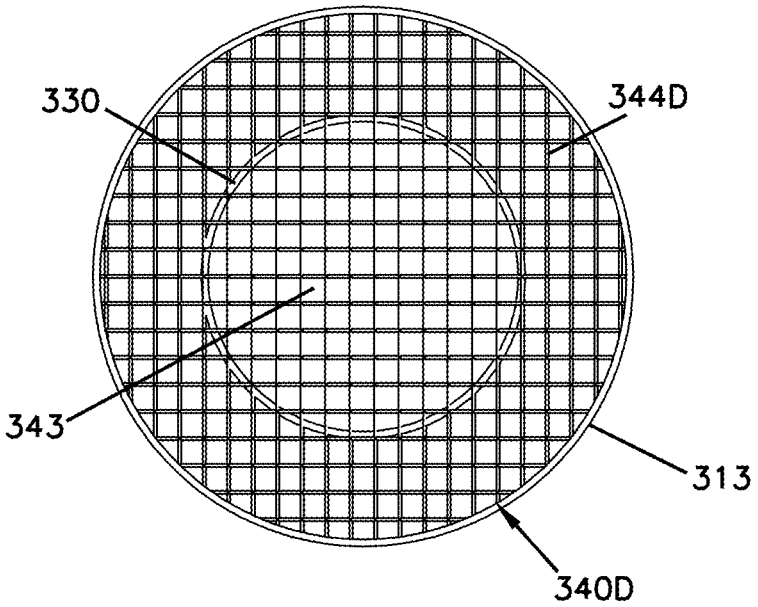
Figure 21:
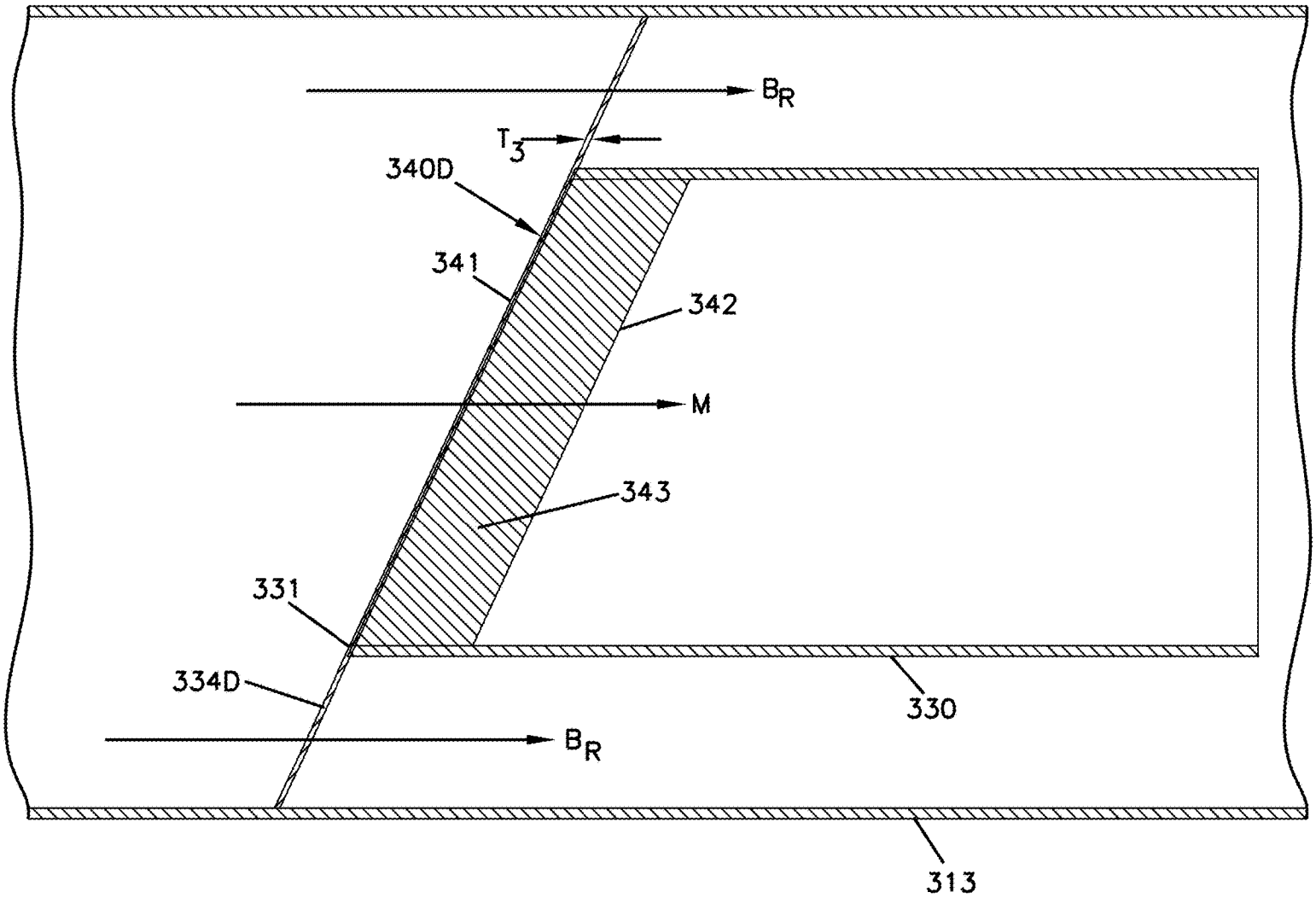
Figure 22:
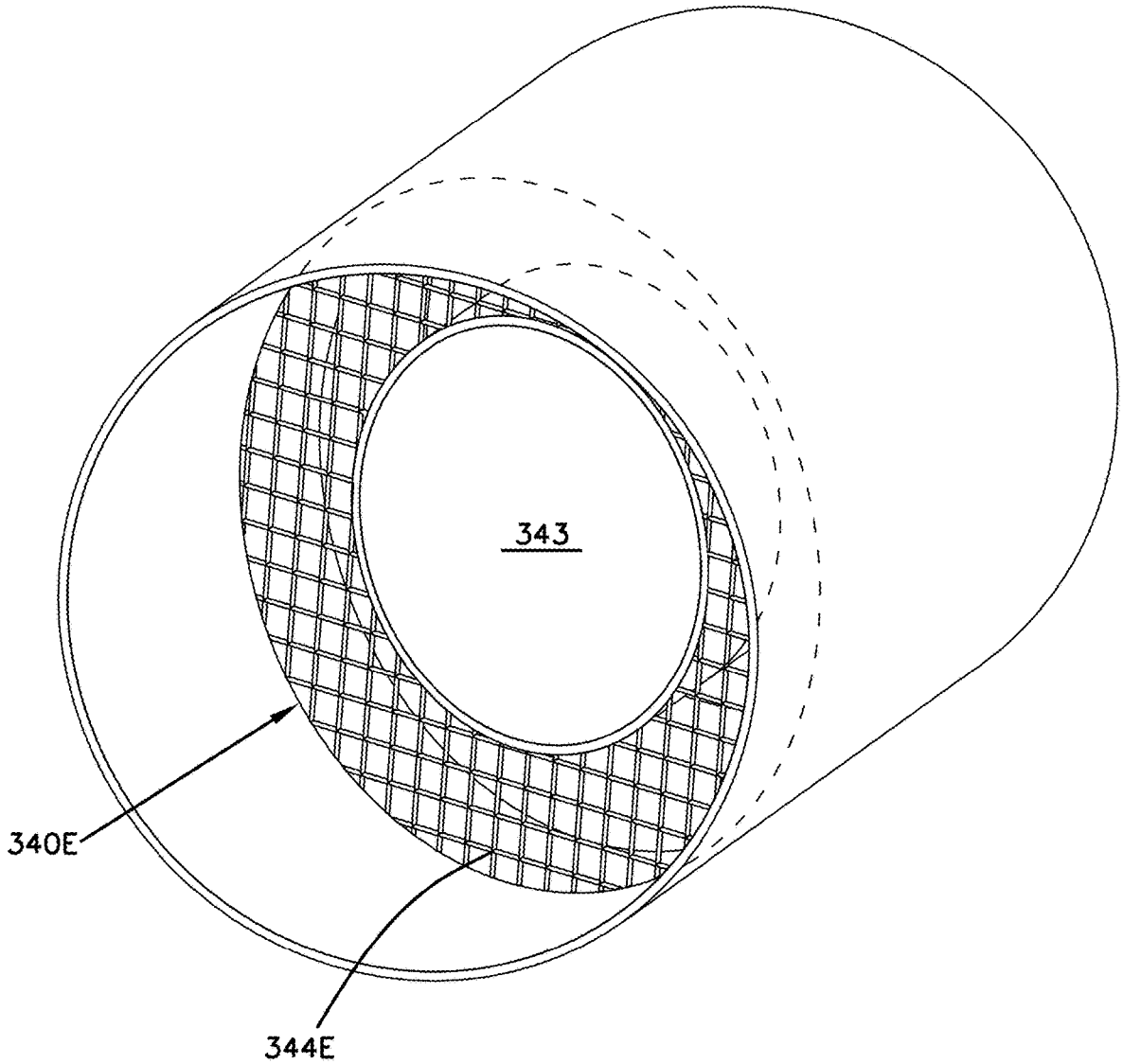
FIG. 22 illustrates an example dispersing arrangement including a dispersing mesh at a first region and a second mesh that restricts access to the bypass.

FIG. 9 is a schematic diagram of another example dosing and mixing unit 200 having a bypass B in accordance with aspects of the disclosure. The dosing and mixing unit 200 includes an exhaust conduit 213 through which exhaust EF flows from an engine. An injector 250 is disposed at a location along the exhaust conduit 213. At least some RF of the exhaust EF continues flowing through the exhaust conduit 213 to the injector 250. The injector 250 is configured to spray or otherwise disperse reactant into the exhaust RF flowing through the exhaust conduit 213. At least some of the exhaust RF entrains the reactant and carries the reactant downstream through the exhaust conduit 213.

A dispersing arrangement 240 is disposed within the exhaust conduit 213 downstream of the injector 250. At least some of the exhaust RF carrying the reactant impinges on the dispersing arrangement 240, which breaks up droplets of the reactant. The dispersing arrangement 240 may also provide heat to some reactant to aid in the vaporization process. In some implementations, the dispersing arrangement 240 extends across less than a full cross-section of the exhaust conduit 213. In other implementations, the dispersing arrangement 240 extends fully across the inner cross-section of the exhaust conduit 213. In an example, the dispersing arrangement 240 extends at a non-perpendicular angle relative to a longitudinal axis of the exhaust conduit 213.

In various implementations, the dispersing arrangement 240 includes a mesh, a sponge (e.g., foam or metal), and/or a tortuous path baffle arrangement. In certain implementations, the dispersing arrangement 240 is a mesh formed from a knit, a weave, or a jumbling of one or more metal wires. Each wire is thin to facilitate heating of the wire. In an example, the dispersing arrangement 240 is formed from a continuous weave of a metal wire. In an example, the dispersing arrangement 240 is formed from stainless steel. In certain examples, the dispersing arrangement 240 is coated in $TiO_2$.

A bypass passage 260 is provided that allows at least some BF of the exhaust EF to bypass the dispersing arrangement 240. The exhaust BF enters the bypass passage 260 upstream of the injector 250 and exits the bypass passage 260 downstream of the dispersing arrangement 240. The exhaust BF following the bypass contains little to no reactant. Accordingly, the reactant is unlikely to build up within the passage 260. In some implementations, the bypass passage 260 is formed by a separate pipe connected to the exhaust conduit. In other implementations, the bypass passage 260 includes a sectioned off portion of the exhaust conduit 213.

In some implementations, a mixer 230 is disposed downstream of the dispersing arrangement 240. The mixer 230 causes the exhaust RF flowing through the dispersing arrangement 240 to mix with the exhaust BF flowing from the bypass passage 260 to form a swirling exhaust flow SF. In some implementations, the mixer 230 includes a mixing conduit, such as one of the mixing conduits described above. In other implementations, the mixer 230 includes a flow device having one or more apertures and optionally louvers, scoops, pipes, or other structure to direct the flow in a swirling pattern. In still other implementations, the exit of the bypass passage 260 is angled relative to the exhaust conduit 213 to cause swirling or other rotation of the exhaust flow BF as the exhaust BF leaves the bypass passage 260.

FIGS. 10-21 illustrate various alternative implementations 340A-340D for the dispersing arrangement. Each of the example dispersing arrangements 340A-340D is configured to be disposed at the upstream end of a mixing conduit (e.g., conduit 130 of FIGS. 4-8) that may include one or more flow entry regions. For convenience, an example mixing conduit 330 and an example exhaust conduit 313 are shown schematically. However, it will be understood that any of the dispersing arrangements 340A-340D can be used with any of the mixing conduits 30, 130, 230 described above or a different mixing conduit. As shown, each of the dispersing arrangements 340A-340C can be oriented at an angle relative to a central longitudinal axis of the exhaust conduit 313.

In some implementations, the mixing conduit 330 is structured so that an interior of the mixing conduit 330 is devoid of flow impediments in longitudinal alignment with the dispersing arrangement 340A-340D, thereby allowing exhaust to flow through the mixing conduit 330 downstream of the dispersing arrangement 340A-340D without impinging on any surface other than an inner through-passage surface of the mixing conduit 330. For example, in certain implementations, the mixing conduit 330 is generally hollow. In certain examples, a cross-dimension (e.g., diameter) of the mixing conduit 330 is not reduced downstream of the dispersing arrangement 340A-340D.

In some implementations, the dosing and mixing unit (e.g., dosing and mixing unit 110) is structured so that reductant carried by exhaust passing through the mixing conduit 330 does not impinge upon any structure within a distance of at least about an inch downstream of the dispersing arrangement 340A-340D. In certain implementations, the dosing and mixing unit is structured so that reductant does not impinge upon any structure within a distance of at least about six inches downstream of the dispersing arrangement 340A-340D. In certain implementations, the dosing and mixing unit is structured so that reductant does not impinge upon any structure within a distance of at least about one foot downstream of the dispersing arrangement 340A-340D. In certain implementations, the dosing and mixing unit is structured so that reductant does not impinge upon any structure within a distance of at least about two feet downstream of the dispersing arrangement 340A-340D. In certain implementations, the dosing and mixing unit is structured so that reductant does not impinge upon any structure within a distance of at least about thirty inches downstream of the dispersing arrangement 340A-340D. In certain implementations, the dosing and mixing unit is structured so that reductant does not impinge upon any structure within a distance of at least about three feet downstream of the dispersing arrangement 340A-340D. In other implementations, mixing structures, dispersing structures, and/or other impingement structures can be provided downstream of the dispersing arrangement.

The example dispersing arrangements 340A-340D includes a first region 343 that extends across the upstream end 331 of the mixing conduit 330 so that exhaust longitudinally entering the mixing conduit 330 passes through the first region 343. The example dispersing arrangements 340A-340D also include one or more portions that restrict passage to the bypass extending between an exterior of the mixing conduit 330 and an inner surface of the exhaust conduit 313. As the term is used herein, passage to the bypass is restricted when exhaust passes through some portion of the dispersing arrangement 340A-340D to reach the bypass. Some of the example dispersing arrangements 340B, 340C also define unrestricted passages to the bypass, where exhaust can flow around the dispersing arrangement 340B, 340C to reach the bypass.

FIGS. 10-22 illustrate example dispersing arrangements 340A, 340B, 340C, 340D, 340E that includes the first region 343 and a second region 344A-344E. In some implementations, the first region 343 aligns with the mixing conduit 330; and the second region extends between the mixing conduit 330 and the exhaust conduit 313 (e.g., see second regions 344A-344C and 344E). In other examples, the second region 344D extends over the first region 343. The second region 344A-344E provides a restricted entrance to the bypass B defined between the mixing conduit 330 and the exhaust conduit 313. The second region 344A-344E provides less resistance to air flow than the first region 343. For example, the second region 344A-344E can be axially thinner, less dense, more porous, etc. than the respective first region 343. Accordingly, exhaust can more easily pass through the second region 344 of the dispersing arrangement 340A than the first region 343.

In some implementations, the first region 343 and the second region 344A, 344D, 344E of the dispersing arrangement 340A, 340D, 340E cooperate to fully extend across the cross-sectional area of the exhaust conduit 313 (see dispersing arrangements 340A, 340D, 340E). For example, in some implementations, the second region 344A, 344E of the dispersing arrangement 340A, 340E may form a ring around the first region 343 (see FIGS. 10-12 and 22). In other implementations, the second region 344D of the dispersing arrangement 340D may extend over and outwardly from the first region 343 (see FIGS. 19-21). Accordingly, no exhaust can flow downstream of the dispersing arrangement 340A, 340D, 340E without passing through some portion of the dispersing arrangement 340A, 340D, 340E. In use, a main flow path M enters the upstream end 331 of the mixing conduit 330 via the first region 343 of the dispersing arrangement 340A, 340D, 340E. A restricted bypass flow path BR extends through the second region 344A, 344D, 344E of the dispersing arrangement 340A, 340D, 340E to the bypass B.

In other implementations, the first region 343 and the second region 344B, 344C of the dispersing arrangements 340B, 340C do not fully extend across the cross-sectional area of the exhaust conduit 313 (see FIGS. 12-18). Rather, unimpeded passage is provided from the exhaust conduit 313 upstream of the dispersing arrangement 340B, 340C to the bypass B downstream of the dispersing arrangement 340B, 340C. For example, one or more openings 346 can be defined between the first region 343, edges 345 of the second region 344B, 344C, and an inner surface of the exhaust conduit 313. In other examples, one or more openings 346 may be defined in the second region 344B, 344C. In such examples, a main flow path M is defined through the first region 343 of the dispersing arrangements 340B, 340C, a restricted bypass flow path BR is defined through the second region 344B, 344C of the dispersing arrangements 340B, 340C, and an unrestricted bypass flow path Bu is defined through the one or more openings 346.

In certain implementations, the first region 343 of the dispersing arrangements 340B, 340C is disposed at a central portion of the exhaust conduit 313, leaving a ring-shaped opening 346 around the first region 343; and the second region 344B, 344C of the dispersing arrangements 340B, 340C extends across one or more portions of the ring-shaped opening 346. In certain examples, the second region 344B, 344C may cooperate with the first region 343 to extend across a width of the exhaust conduit 313. In an example, the second region 344B, 344C may cooperate with the first region 343 to extend across a diameter of the exhaust conduit 313.

In some examples, the second region 344B of the dispersing arrangements 340B includes a single section of dispersing material extending across a portion of the ring-shaped opening 346. In the example shown in FIGS. 13-15, the second region 344B extends in a single section across an upper portion of the ring-shaped opening 346. Accordingly, when used with the mixing conduit 130 shown above, the unrestricted bypass flow path $B_U$ would lead to the first flow entry region 135. Both the unrestricted bypass flow path $B_U$ and the restricted bypass flow path $B_R$ would lead to the second flow entry region 136. In the example shown, the single section can extend around about half of the ring-shaped opening 346. In other examples, the single section can extend around a greater or lesser portion (e.g., a quarter, a third, three-quarters, two-thirds, etc.) of the ring-shaped opening 346.

In other examples, the second region 344C of the dispersing arrangements 340C includes two or more sections of dispersing material extending across one or more portions of the ring-shaped opening 346. In the example shown in FIGS. 16-18, first and second sections extend from an exterior circumference of the first region 343 (or exterior of the mixing conduit 330) to an inner surface of the exhaust conduit 313. In the example shown, the first and second sections of the second region 344C can be aligned so that the second region 344C cooperates with the first region 343 to extend across a width of the exhaust conduit 313. In other implementations, the first and second sections can be otherwise disposed along the ring-shaped opening 346. In still other implementations, additional sections can be disposed at the ring-shaped opening 346.

In some implementations, the first and second regions 343, 344A-344C of the dispersing arrangements 340A-340C are formed of the same mesh material, but the first region 343 has more layers of the material than the second region 344A-344C (e.g., see dispersing arrangements 340A-340C). Accordingly, the first region 343 of the dispersing arrangement 340A-340C has a first thickness T1 and the second region 344A-344C has a second thickness T2 that is less than the first thickness T1.

In other implementations, the second region 344D, 344E of the dispersing arrangement 340D, 340E is formed of a different material and/or has a different structure than the first region 343. For example, the first region 343 may include a first mesh material and the second region 344D, 344E may include a second mesh material (see FIGS. 19-22), which has larger openings than the first mesh material of the first region 343. In certain examples, the second mesh material includes crisscrossing wires. In certain examples, the crisscrossing wires can be woven or welded together. In certain examples, the second region 344D, 344E has a third thickness T3 that may be smaller than the second thickness T2 (e.g., see FIG. 21). In other implementations, the second region 344D, 344E can be formed from a perforated plate that extends partially or fully across the exhaust conduit 313.

In any of the embodiments disclosed above, the dispersing arrangement 40, 140, 240, 340A-340E includes the first mesh material, which is formed from a knit, a weave, or a jumbling of one or more metal wires. It is noted that the user of the term "wire" is not intended to connote a particular minimum transverse cross-dimension (e.g., thickness or diameter) of the metal wire. Each wire is sufficiently thin to facilitate heating of the wire. In some implementations, the thinness of the wires promotes evaporation of dosing material impinging on the wires. In an example, the metal wires have round transverse cross-sections. In other examples, the transverse cross-sections of the metal wires can have any desired shape (e.g., oblong, rectangular, square, triangular, etc.).

In certain implementations, the first mesh material of any of the dispersing arrangements 40, 140, 240, 340A-340E includes wires having diameters that are 100 times smaller than an upstream end of the mixing conduit. In certain implementations, the mesh of any of the dispersing arrangements 40, 140, 240, 340A-340E includes wires having diameters that are 1,000 times smaller than an upstream end of the mixing conduit. In certain implementations, the mesh of any of the dispersing arrangements 40, 140, 240, 340A-340E includes wires having diameters that are 10,000 times smaller than an upstream end of the mixing conduit. In certain implementations, the mesh of any of the dispersing arrangements 40, 140, 240, 340A-340E includes wires having diameters that are 100,000 times smaller than an upstream end of the mixing conduit.

In some implementations, transverse cross-dimensions of the metal wires of any of the dispersing arrangements 40, 140, 240, 340A-340E are no more than 0.011 inches. In certain implementations, transverse cross-dimensions of the metal wires of any of the dispersing arrangements 40, 140, 240, 340A-340E are no more than 0.01 inches. In certain implementations, the transverse cross-dimensions of the metal wires of any of the dispersing arrangements 40, 140, 240, 340A-340E are no more than 0.008 inches. In certain implementations, the transverse cross-dimensions of the metal wires of any of the dispersing arrangements 40, 140, 240, 340A-340E are no more than 0.007 inches. In certain implementations, the transverse cross-dimensions of the metal wires of any of the dispersing arrangements 40, 140, 240, 340A-340E are no more than 0.006 inches.

Figure 24:
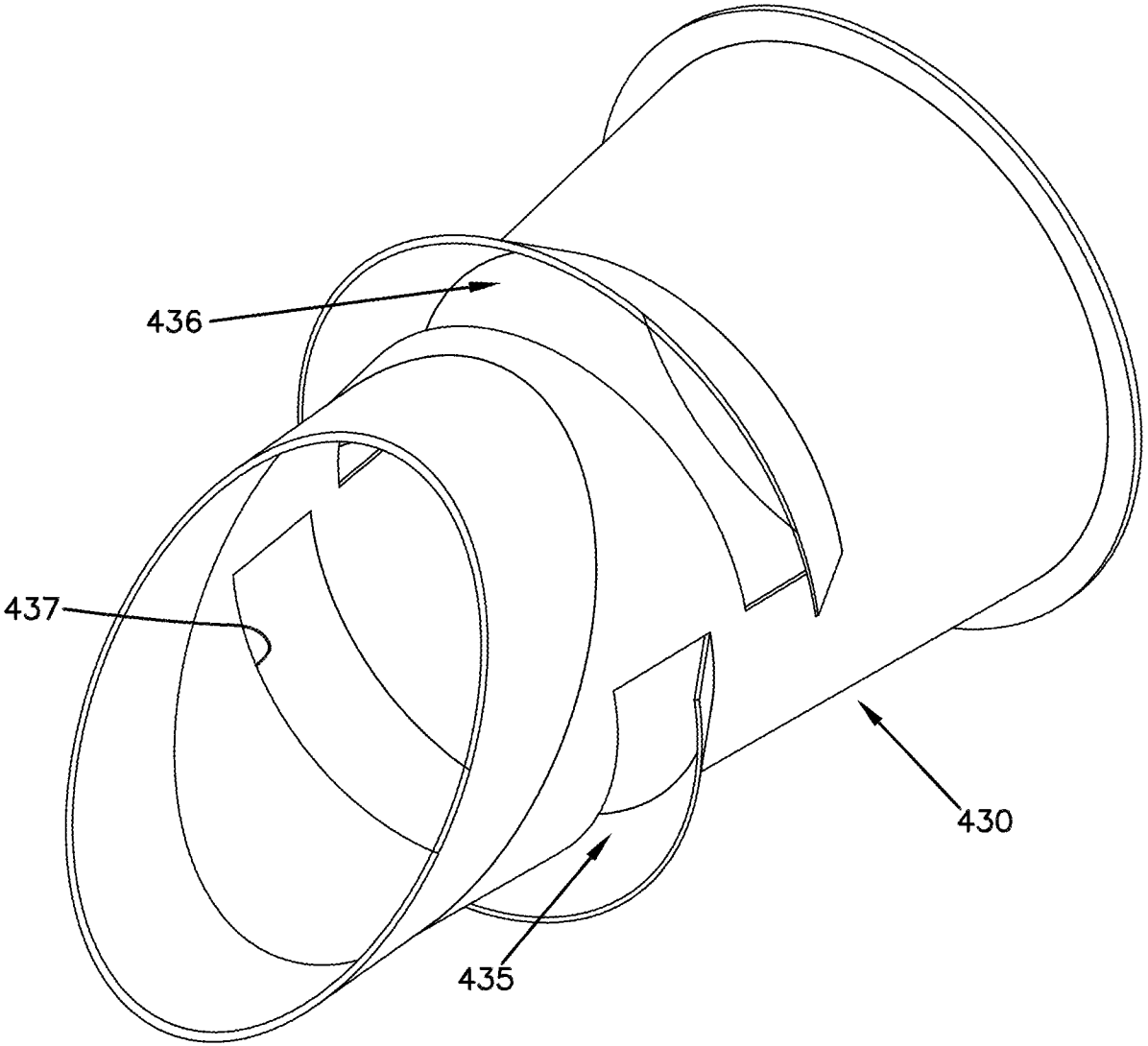
FIG. 24 is a perspective view of yet another mixing conduit and dispersing arrangement in accordance with the principles of the present disclosure.
Figure 25:
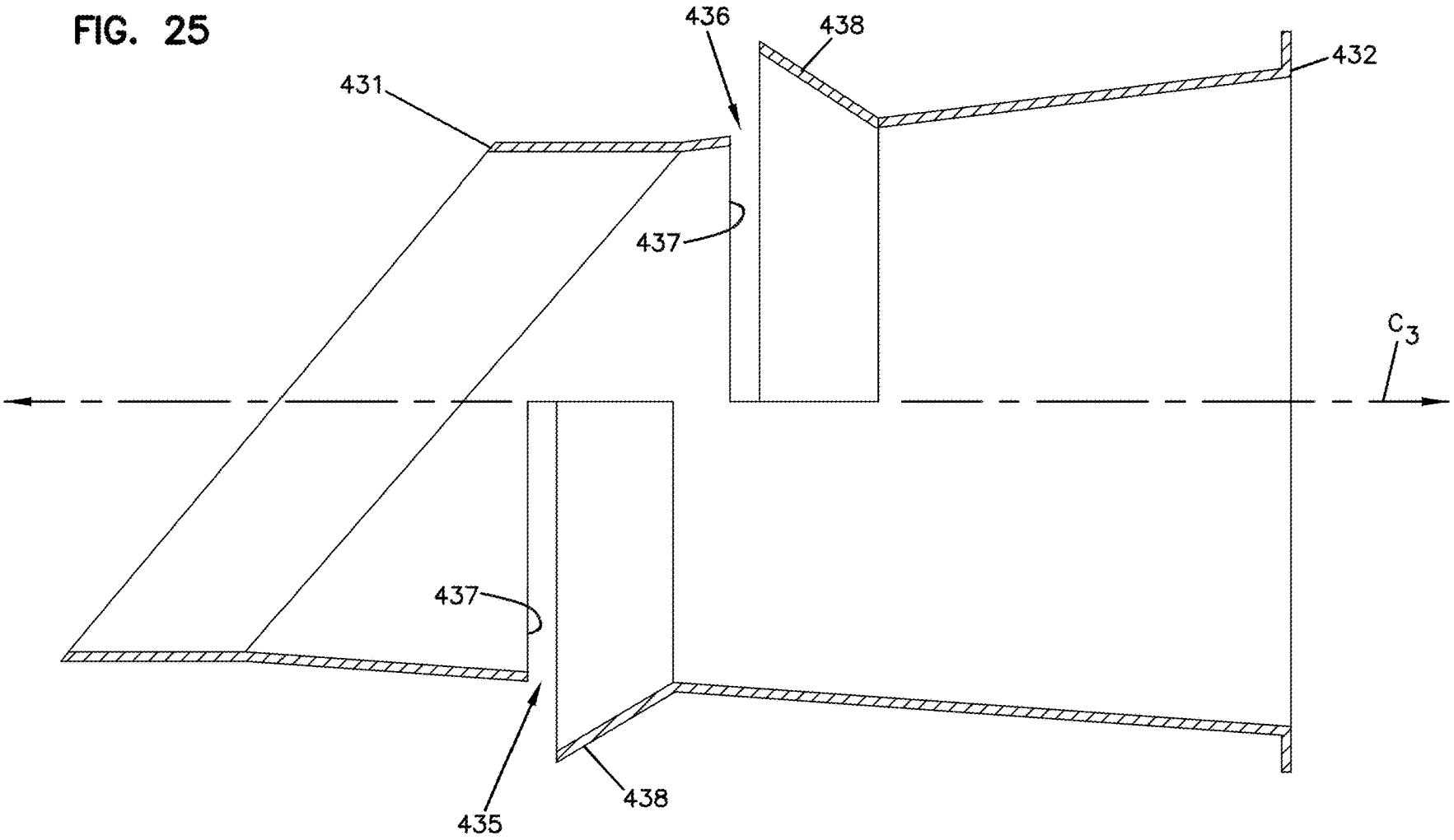
FIG. 25 is an axial cross-sectional view of the mixing conduit of FIG. 24.

FIGS. 24 and 25 illustrate another example mixing conduit 430 suitable for use in the mixing and dosing unit 111 described above. The mixing conduit 430 extends from the upstream end 431 to the downstream end 432 and defines a hollow interior (FIG. 25). The second end 432 is configured to be coupled to the exhaust conduit 113 to hold the mixing conduit 430 at a fixed position within the exhaust conduit 113. A remainder of the mixing conduit 430 is sized to fit within the exhaust conduit 113 without contacting an inner surface of the exhaust conduit 113. The mixing conduit 430 is configured to mix exhaust passing through the mixing conduit 430.

In some implementations, the upstream end 431 of the mixing conduit 430 is configured to couple to a dispersing arrangement (e.g., dispersing arrangement 140 described above) through which at least some exhaust flow enters the hollow interior of the mixing conduit 430. In accordance with some aspects of the disclosure, a bypass is provided between a portion of the mixing conduit 430 and the exhaust conduit 113. The bypass extends through a circumferential gap along a portion of the length of the mixing conduit 430 to allow exhaust to flow past the upstream end of the mixing conduit 430. In certain examples, the bypass allows exhaust to flow past the dispersing arrangement. In certain implementations, the bypass provides an annular passage through which exhaust can enter the mixing conduit 430 downstream of the dispersing arrangement.

The bypass leads to one or more downstream entrances into the mixing conduit 430. At least some of the exhaust that does not enter the mixing conduit 430 through the dispersing arrangement can instead enter the mixing conduit 430 at the downstream entrances. For example, in some implementations, the sidewall of the mixing conduit 430 defines a first radial flow entry region 435 at which exhaust can flow from the bypass into the interior of the mixing conduit 430.

The first radial flow entry region 435 is disposed at a location spaced (e.g., along the central axis C3) from the upstream end 431 of the mixing conduit 430. In certain examples, the first radial flow entry region 435 is disposed at or immediately downstream of the dispersing arrangement. In certain examples, at least a portion of the first radial flow entry region 435 overlaps at least a portion of the dispersing arrangement. In some implementations, the first radial flow entry region 435 is positioned so that exhaust entering the mixing conduit 430 through the first radial flow entry region 435 entrains reactant passing through the dispersing arrangement to inhibit deposition of the reactant on a lower inner surface of the mixing conduit 430. In certain examples, the first radial flow entry region 435 may be provided at a bottom of the mixing conduit 430 so that exhaust entering the mixing conduit 430 through the first radial flow entry 435 carries the reactants upwardly away from the bottom of the mixing conduit 430.

A circumferentially elongated aperture 437 is provided at the first radial flow entry region 435 to enable exhaust to flow into the mixing conduit 430. The aperture 437 is elongated circumferentially around the sidewall of the mixing conduit 430. In an example, the aperture 437 extends around about half of a circumference of the sidewall. In other examples, the aperture 437 can extend around about a third of the sidewall, a quarter of the sidewall, or a fifth of the sidewall. The dimension (axial width) of the aperture 437 along the central axis C3 of the mixing conduit 430 is substantially less than the dimension (circumferential length) of the aperture 437 along the circumference of the sidewall.

In certain examples, a structure (e.g., a louver 438 or baffle) can be provided at the first radial flow entry region 435 to impart rotation or turbulence to the flow passing through the first radial flow entry region 435. The louver 438 at the aperture 437 extends radially outwardly from the mixing conduit 430 and forwardly towards the upstream end 431 of the mixing conduit 430.

In some implementations, a second radial flow entry region 436 can be provided at the sidewall of the mixing conduit 430 at a location spaced downstream of the first radial flow entry region 435 (e.g., see FIG. 25). A circumferentially elongated aperture 437 is provided at the second radial flow entry region 436 to enable exhaust to flow into the mixing conduit 430. In an example, the aperture 437 at the second radial flow entry region 436 extends around about half of a circumference of the sidewall. In other examples, the aperture 437 at the second radial flow entry region 436 can extend around about a third of the sidewall, a quarter of the sidewall, or a fifth of the sidewall. The dimension (axial width) of the aperture 437 at the second radial flow entry region 436 along the central axis C3 of the mixing conduit 430 is substantially less than the dimension (circumferential length) of the aperture 437 along the circumference of the sidewall. In certain examples, the aperture 437 at the second radial flow entry region 436 does not overlap with the aperture 437 at the first radial flow entry region 435.

In certain examples, one or more louvers or baffles 438 can be provided at the second radial flow entry region 436. The louver(s) or baffle(s) 438 can impart a rotation or turbulence to the exhaust as the exhaust enters the mixing conduit 430 through the aperture 437 at the second radial flow entry region 436. For example, the louvers or baffles 438 can cause the exhaust to mix together with the axially flowing exhaust that entered through the dispersing arrangement. In an example, the second radial flow entry region 436 extends around a partial circumference of the mixing conduit 430.

The louver 438 at the second radial flow entry region 436 extends radially outwardly from the mixing conduit 430 and forwardly towards the upstream end 431 of the mixing conduit 430. In examples, the louver or baffle 438 at the second radial flow entry region 436 does not overlap with the louver or baffle 438 at the first radial flow entry region 435. The louver 438 at the second radial flow entry region 436 is axially spaced from the louver or baffle 438 at the first radial flow entry region 435.

In some implementations, the mixing conduit 430 is structured so that an interior of the mixing conduit 430 is devoid of flow impediments in longitudinal alignment with the dispersing arrangement, thereby allowing exhaust to flow through the mixing conduit 430 downstream of the dispersing arrangement without impinging on any surface other than an inner through-passage surface of the mixing conduit 430. For example, in certain implementations, the mixing conduit 430 is generally hollow. In certain examples, the louvers 438 extend outwardly from the mixing conduit 430 and not into an interior of the mixing conduit 430. In certain examples, a cross-dimension (e.g., diameter) of the mixing conduit 430 is not reduced downstream of the dispersing arrangement. In the example shown, the cross-dimension of the mixing conduit 430 increases as the mixing conduit 430 extends downstream of the dispersing arrangement.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. An exhaust treatment system comprising:

an exhaust conduit including a linear section defining an inner circumferential surface;

a first mixing arrangement defining a first mixing region disposed within the linear section of the exhaust conduit and at which exhaust is swirled in a first swirl direction, the first mixing arrangement including a first plurality of louvers facing in a first circumferential direction;

a second mixing arrangement defining a second mixing region disposed within the linear section of the exhaust conduit and at which exhaust is swirled in a second swirl direction that is opposite the first swirl direction, the second mixing arrangement including a second plurality of louvers facing in a second circumferential direction that is opposite the first circumferential direction, the first and second pluralities of louvers being carried on a common mixing body, the second mixing region being disposed downstream from the first mixing region;

a restrictor disposed within the linear section of the exhaust conduit and contacting the inner circumferential surface of the exhaust conduit at a contact location downstream of the second mixing region, the inner circumferential surface having a first internal diameter at the contact location, the restrictor separating the exhaust conduit into a first section upstream of the contact location and a second section downstream of the contact location, the restrictor providing a restricted flow path between the first and second sections of the exhaust conduit, the restricted flow path being open along a central axis of the exhaust conduit, the restricted flow path having a second internal diameter at an entrance to the restricted flow path that is smaller than the first internal diameter; and a doser mounting location disposed along the exhaust conduit, the doser mounting location being configured to receive a doser.

2. The exhaust treatment system of claim 1, wherein the first plurality of louvers extend over less than a full circumference of the first mixing region.

3. The exhaust treatment system of claim 1, wherein the second plurality of louvers extend over a full circumference of the second mixing region.

4. The exhaust treatment system of claim 1, wherein the doser mounting location is upstream of the second mixing arrangement.

5. The exhaust treatment system of claim 4, wherein the doser mounting location is upstream of the first mixing arrangement.

6. The exhaust treatment system of claim 4, wherein the doser mounting location is upstream of the entrance to the restricted flow path.

7. The exhaust treatment system of claim 1, wherein the restrictor has a first entrance disposed a first radial distance from the circumferential surface of the exhaust conduit and has a second entrance disposed a second radial distance from the circumferential surface of the exhaust conduit, the second radial distance being different from the first radial distance.

8. The exhaust treatment system of claim 7, wherein the second entrance is disposed at a different axial location along the exhaust conduit than the first entrance.

9. The exhaust treatment system of claim 7, wherein the first entrance is disposed at the first mixing region and the second entrance is disposed at the second mixing region.

10. The exhaust treatment system of claim 1, wherein the doser mounting location is oriented so that any doser mounted at the doser mounting location injects reactant along a doser axis.

11. The exhaust treatment system of claim 10, wherein the doser axis extends towards the first mixing region.

12. The exhaust treatment system of claim 11, wherein the doser axis is angled relative to the central axis of the exhaust conduit.

13. The exhaust treatment system of claim 10, further comprising an impingement surface aligned with the doser axis, the impingement surface restricting but not preventing reactant from passing through the impingement surface.

14. The exhaust treatment system of claim 13, wherein the impingement surface is disposed upstream of the second mixing arrangement.

15. The exhaust treatment system of claim 14, wherein at least a portion of the impingement surface overlaps at least a portion of the first mixing arrangement.

16. The exhaust treatment system of claim 14, wherein at least a portion of the impingement surface is disposed upstream of the first mixing arrangement.

17. The exhaust treatment system of claim 16, wherein the impingement surface is an upstream end face of a wire mesh component.

18. An exhaust treatment system comprising:

an exhaust conduit defining an inner circumferential surface having a first internal diameter;

a first mixing arrangement defining a first mixing region disposed within the exhaust conduit and at which exhaust is swirled in a first swirl direction;

a second mixing arrangement defining a second mixing region disposed within the exhaust conduit and at which exhaust is swirled in a second swirl direction that is opposite the first swirl direction, the second mixing region being disposed downstream from the first mixing region;

a restrictor disposed within the exhaust conduit and contacting the inner circumferential surface of the exhaust conduit at a contact location downstream of the second mixing region, the restrictor separating the exhaust conduit into a first section upstream of the contact location and a second section downstream of the contact location, the restrictor providing a restricted flow path between the first and second sections of the exhaust conduit, the restricted flow path being open along a central axis of the exhaust conduit, the restricted flow path having a second internal diameter at an entrance to the restricted flow path that is smaller than the first internal diameter;

a doser mounting location disposed along the exhaust conduit, the doser mounting location being configured to receive a doser, wherein the doser mounting location is oriented so that any doser mounted at the doser mounting location injects reactant along a doser axis;

an impingement surface aligned with the doser axis, the impingement surface restricting but not preventing reactant from passing through the impingement surface, the impingement surface being disposed upstream of the second mixing arrangement, at least a portion of the impingement surface being disposed upstream of the first mixing arrangement, and the impingement surface being an upstream end face of a wire mesh component.

19. An exhaust treatment system comprising:

an exhaust conduit including a linear section defining an inner circumferential surface;

a first mixing arrangement defining a first mixing region disposed within the linear section of the exhaust conduit and at which exhaust is swirled in a first swirl direction, wherein the first mixing arrangement includes a first plurality of louvers facing in a first circumferential direction, wherein the first plurality of louvers extend over less than a full circumference of the first mixing region;

a second mixing arrangement defining a second mixing region disposed within the linear section of the exhaust conduit and at which exhaust is swirled in a second swirl direction that is opposite the first swirl direction, the second mixing region being disposed downstream from the first mixing region;

a restrictor disposed within the linear section of the exhaust conduit and contacting the inner circumferential surface of the exhaust conduit at a contact location downstream of the second mixing region, the inner circumferential surface having a first internal diameter at the contact location, the restrictor separating the exhaust conduit into a first section upstream of the contact location and a second section downstream of the contact location, the restrictor providing a restricted flow path between the first and second sections of the exhaust conduit, the restricted flow path being open along a central axis of the exhaust conduit, the restricted flow path having a second internal diameter at an entrance to the restricted flow path that is smaller than the first internal diameter; and a doser mounting location disposed along the exhaust conduit, the doser mounting location being configured to receive a doser.

20. An exhaust treatment system comprising:

an exhaust conduit including a linear section defining an inner circumferential surface;

a first mixing arrangement defining a first mixing region disposed within the linear section of the exhaust conduit and at which exhaust is swirled in a first swirl direction;

a second mixing arrangement defining a second mixing region disposed within the linear section of the exhaust conduit and at which exhaust is swirled in a second swirl direction that is opposite the first swirl direction, the second mixing region being disposed downstream from the first mixing region;

a restrictor disposed within the linear section of the exhaust conduit and contacting the inner circumferential surface of the exhaust conduit at a contact location downstream of the second mixing region, the inner circumferential surface having a first internal diameter at the contact location, the restrictor separating the exhaust conduit into a first section upstream of the contact location and a second section downstream of the contact location, the restrictor providing a restricted flow path between the first and second sections of the exhaust conduit, the restricted flow path being open along a central axis of the exhaust conduit, the restricted flow path having a second internal diameter at an entrance to the restricted flow path that is smaller than the first internal diameter; and a doser mounting location disposed along the exhaust conduit, the doser mounting location being configured to receive a doser, wherein the doser mounting location is upstream of the second mixing arrangement, wherein the doser mounting location is upstream of the first mixing arrangement.

21. An exhaust treatment system comprising:

an exhaust conduit including a linear section defining an inner circumferential surface;

a first mixing arrangement defining a first mixing region disposed within the linear section of the exhaust conduit and at which exhaust is swirled in a first swirl direction;

a second mixing arrangement defining a second mixing region disposed within the linear section of the exhaust conduit and at which exhaust is swirled in a second swirl direction that is opposite the first swirl direction, the second mixing region being disposed downstream from the first mixing region;

a restrictor disposed within the linear section of the exhaust conduit and contacting the inner circumferential surface of the exhaust conduit at a contact location downstream of the second mixing region, the inner circumferential surface having a first internal diameter at the contact location, the restrictor separating the exhaust conduit into a first section upstream of the contact location and a second section downstream of the contact location, the restrictor providing a restricted flow path between the first and second sections of the exhaust conduit, the restricted flow path being open along a central axis of the exhaust conduit, the restricted flow path having a second internal diameter at an entrance to the restricted flow path that is smaller than the first internal diameter, wherein the restrictor has a first entrance disposed a first radial distance from the circumferential surface of the exhaust conduit and has a second entrance disposed a second radial distance from the circumferential surface of the exhaust conduit, the second radial distance being different from the first radial distance, the first entrance being disposed at the first mixing region and the second entrance being disposed at the second mixing region; and a doser mounting location disposed along the exhaust conduit, the doser mounting location being configured to receive a doser.

22. An exhaust treatment system comprising:

an exhaust conduit including a linear section defining an inner circumferential surface;

a first mixing arrangement defining a first mixing region disposed within the linear section of the exhaust conduit and at which exhaust is swirled in a first swirl direction;

a second mixing arrangement defining a second mixing region disposed within the linear section of the exhaust conduit and at which exhaust is swirled in a second swirl direction that is opposite the first swirl direction, the second mixing region being disposed downstream from the first mixing region;

a restrictor disposed within the linear section of the exhaust conduit and contacting the inner circumferential surface of the exhaust conduit at a contact location downstream of the second mixing region, the inner circumferential surface having a first internal diameter at the contact location, the restrictor separating the exhaust conduit into a first section upstream of the contact location and a second section downstream of the contact location, the restrictor providing a restricted flow path between the first and second sections of the exhaust conduit, the restricted flow path being open along a central axis of the exhaust conduit, the restricted flow path having a second internal diameter at an entrance to the restricted flow path that is smaller than the first internal diameter;

a doser mounting location disposed along the exhaust conduit, the doser mounting location being configured to receive a doser, wherein the doser mounting location is oriented so that any doser mounted at the doser mounting location injects reactant along a doser axis; and an impingement surface aligned with the doser axis, the impingement surface restricting but not preventing reactant from passing through the impingement surface, wherein the impingement surface is disposed upstream of the second mixing arrangement.

* * * * *